US006346017B1

(12) United States Patent
Silorey et al.

(10) Patent No.: US 6,346,017 B1
(45) Date of Patent: Feb. 12, 2002

(54) GEAR SHIFT MECHANISM FOR MARINE OUTBOARD MOTOR DRIVE UNIT

(75) Inventors: David Silorey, Racine, WI (US); Stephen J. Towner, Libertyville, IL (US)

(73) Assignee: Bombardier Motor Corporation of America, Melbourne, FL (US)

( * ) Notice: Subject to any disclaimer, the term of this patent is extended or adjusted under 35 U.S.C. 154(b) by 0 days.

(21) Appl. No.: 09/621,382

(22) Filed: Jul. 21, 2000

(51) Int. Cl.[7] ..... B63H 20/20
(52) U.S. Cl. ..... 440/75; 440/86; 440/112
(58) Field of Search ..... 440/75, 53, 58, 440/59, 60, 61, 62, 63, 86, 112; 192/84.6

(56) References Cited

U.S. PATENT DOCUMENTS 2,323,619 A * 7/1943 Panish ..... 192/84.6
3,430,604 A * 3/1969 Pike et al. ..... 440/75
3,487,803 A * 1/1970 Alexander, Jr. ..... 440/75
3,520,272 A * 7/1970 Ellzey ..... 440/75
3,968,767 A * 7/1976 Blanchard ..... 440/75
4,591,034 A * 5/1986 Tellert et al. ..... 192/84.6
4,907,994 A * 3/1990 Jones ..... 440/61
4,911,666 A * 3/1990 Gage et al. ..... 440/112
5,080,619 A * 1/1992 Uchida et al. ..... 440/84
5,108,325 A * 4/1992 Livingston et al. ..... 440/112
5,230,643 A * 7/1993 Kanno ..... 440/86

FOREIGN PATENT DOCUMENTS

JP 3-220093 * 9/1991 ..... 440/58

* cited by examiner

*Primary Examiner*—Sherman Basinger
(74) *Attorney, Agent, or Firm*—Armstrong Teasdale LLP

(57) ABSTRACT

A gear shift mechanism for a marine propulsion system includes a reversible DC electric motor, a sliding clevis, and a shift rod for actuating a gearset within a gearcase between forward, reverse, and neutral positions. The mechanism is housed in a watertight gear shift cover that is attached to a trunnion that, in turn, attaches to a top surface of the gearcase. Electronic, logic driven controls reverse the polarity of the motor to manipulate the shift rod via the sliding clevis to shift the gearcase into a selected operating position.

42 Claims, 20 Drawing Sheets

GEAR SHIFT MECHANISM FOR MARINE OUTBOARD MOTOR DRIVE UNIT

BACKGROUND OF THE INVENTION

This invention relates generally to propulsion systems and, more particularly, to a gear shift mechanism for a marine propulsion system.

Mechanical propulsion systems for propelling watercraft generally are classified as either outboard systems or inboard systems. Outboard systems typically are characterized by an outboard motor mounted to a vertical transom plate located on an outside stem of a boat hull. A propeller drive unit is attached to the motor, or powerhead, and extends from the powerhead into the water to generate thrust and propel the watercraft. Outboard motor systems are versatile, compact, and cost-effective units that are relatively easy to install on the boat hull. Also, because the outboard system is attached to the outside of the hull, the outboard motor system generally does not occupy interior space of the boat hull. However, due to structural constraints of the vertical transom plate mounts of outboard systems, watercraft with outboard systems are typically limited to certain motor capacities within size and weight constraints.

Inboard systems are typically characterized by larger, complicated, and relatively expensive engines in comparison to outboard systems. Inboard system engines are mounted in an engine compartment in a boat hull interior, and a drive unit, or stem drive, extends through a vertical wall of the boat hull into the water to generate thrust and propel the watercraft. Inboard systems, however, are much more complicated to install in a boat hull, which further increases the cost of a watercraft. Furthermore, bulky inboard engines and engine compartments often occupy a substantial amount of interior hull space due to the proximity of the engine compartment to a running surface of the hull.

Moreover, known gear shift mechanisms for marine propulsion systems, such as shift lever, cable and hydraulic systems are relatively intricate and difficult to water seal.

BRIEF SUMMARY OF THE INVENTION

In an exemplary embodiment of the invention, a gear shift mechanism for a marine propulsion system includes a reversible DC electric motor, a sliding clevis, and a shift rod for actuating a gearset within a gearcase between forward, reverse, and neutral positions. The mechanism is housed in a watertight gear shift cover that is attached to a top surface of the gearcase. Electronic, logic driven controls reverse the polarity of the motor to manipulate the shift rod via the sliding clevis to shift the gearcase into a selected operating position. In one embodiment, the gearset includes gear reduction that allows a fractional horsepower motor to be used to actuate the clevis and shift rod.

In an exemplary embodiment, the gear shift mechanism is part of a marine propulsion system including an outboard propulsion system powerhead mounted to a horizontal mounting plate in an outside engine compartment formed into a platform extending from a boat hull. The engine compartment is enclosed by an engine cover at a stern of a watercraft. The marine propulsion system includes an upper unit that includes the powerhead and a lower unit that includes a propeller drive unit. A four point mounting assembly eases installation of the upper and lower units and absorbs vibration of the upper and lower units to produce smooth, quiet propulsion of a watercraft. The outboard powerhead is mounted stationary to the horizontal mounting plate, and a steering arm yoke and trunnion assembly is attached to the horizontal mounting plate and extends outside of the boat platform to maneuver the watercraft.

The gear shift mechanism is attached to the lower drive unit below the horizontal mounting plate and rotates, trims, and tilts with the propeller drive unit, at or below the waterline when the boat is in the water. Electronic, logic driven controls reverse the polarity of the motor in the watertight housing and rotate a motor shaft to manipulate the sliding clevis and shift rod to actuate the gearset between forward, reverse, and neutral positions. Thus, a compact, watertight and relatively simple gear shift mechanism is provided in lieu of known shift lever, hydraulic, and cable systems that are relatively complicated and difficult to water seal.

Thus, the gear shift mechanism and the marine propulsion system provide the versatility, compactness and cost savings of an outboard powerhead with the stability and performance advantages of an inboard system. Structural limitations and instability of vertical transom plate mounts are avoided by mounting the outboard powerhead to the horizontal mounting plate in the boat platform.

DETAILED DESCRIPTION OF THE INVENTION

Figure 1:
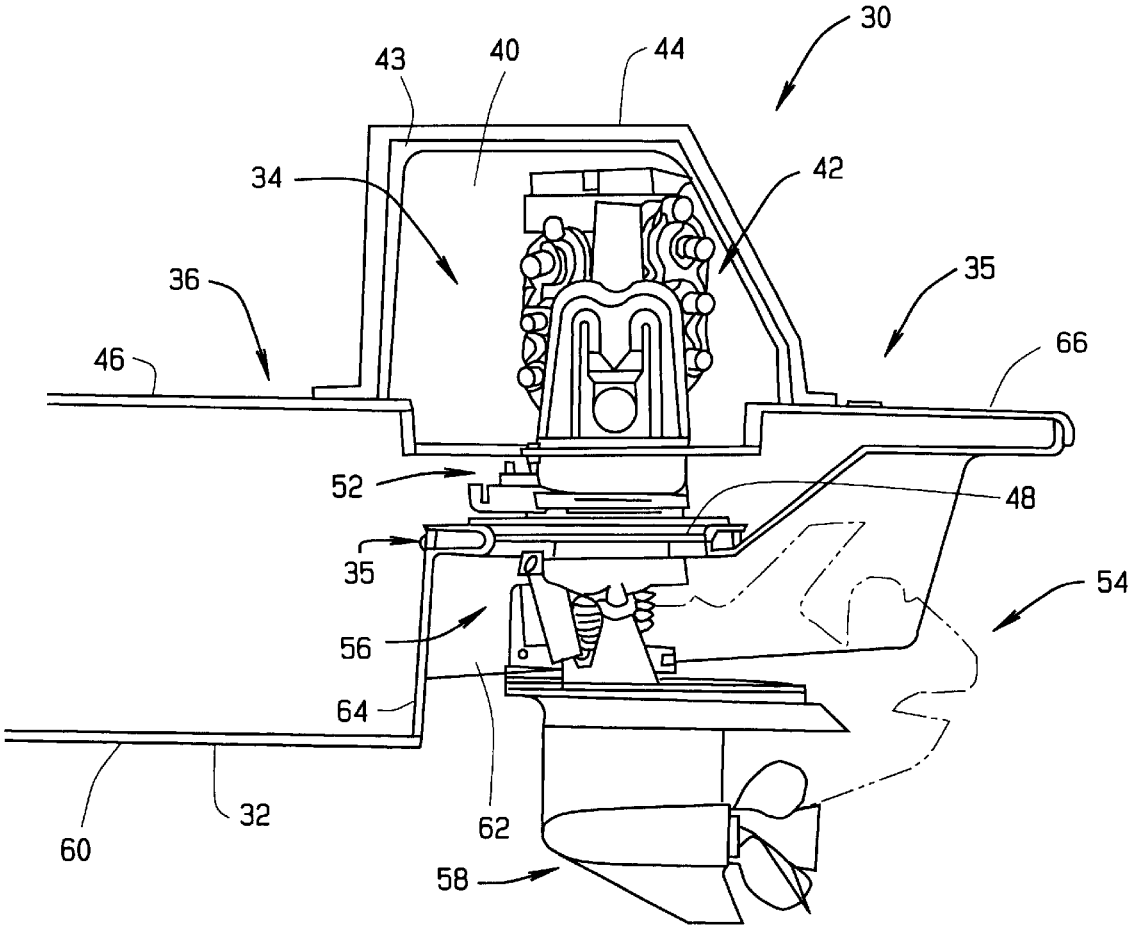
FIG. 1 is a partial cross sectional view of a watercraft including a marine propulsion system.

FIG. 1 is a partial cross sectional view of a watercraft, or boat, 30 including a hull 32 and a marine propulsion system 34 attached to a platform 35 extending from a rear end 36 of an interior (not shown in FIG. 1) of watercraft 30, i.e., an end of the watercraft interior opposite a bow (not shown ) of watercraft 30, to generate thrust to propel watercraft 30 through a body of water. Platform 35 is integrally molded with hull 32, and an outside engine compartment 40 is integral to platform 35 and includes an upper unit 42 of marine propulsion system 34. Engine compartment 40 is closed with an insulated inner engine cover 43 and an outer engine cover 44 adjacent the watercraft interior. Outer engine cover 44 and inner engine cover 43 are fabricated from known materials selected and shaped to improve aesthetics of watercraft 30 and to reduce engine noise to watercraft occupants, respectively. A deck 46 is attached to hull 32 and defines the boat interior.

A horizontal mounting plate 48 is received in a recess (not shown in FIG. 1) extending through platform 35 and is secured to platform 35. A mounting assembly 52 secures upper unit 42 to horizontal mounting plate 48. A lower unit 54 of marine propulsion system 34 is also attached to horizontal mounting plate 48 and includes a steering arm yoke and trunnion assembly 56 coupled to a propeller drive unit 58 depending therefrom. Steering arm yoke and trunnion assembly 56 enables rotational movement of lower unit 54 relative to stationary upper unit 42 to steer watercraft 30, and enables adjustment of a trim and tilt position of lower unit 54 between a full tilt down position (shown in solid in FIG. 1) and a full tilt up position (shown in phantom in FIG. 1).

Hull 32 includes a running surface 60 which, when the boat is planing, rides on the surface of the water, and a pair of platform extensions 62 (only one of which is shown in FIG. 1) extend from hull 32 and flank steering arm yoke and trunnion assembly 56. Extensions 62 extend from a vertical wall 64 and support platform 35. Platform 35 also includes a ledge 66 upon which boat occupants may stand and also utilize to enter and exit watercraft 30. Ledge 66 also prevents water from splashing into engine compartment 40 when watercraft 30 is propelled by marine propulsion system 34 in a reverse direction and when a speed of watercraft 30 in a forward direction is suddenly decreased.

Figure 2:
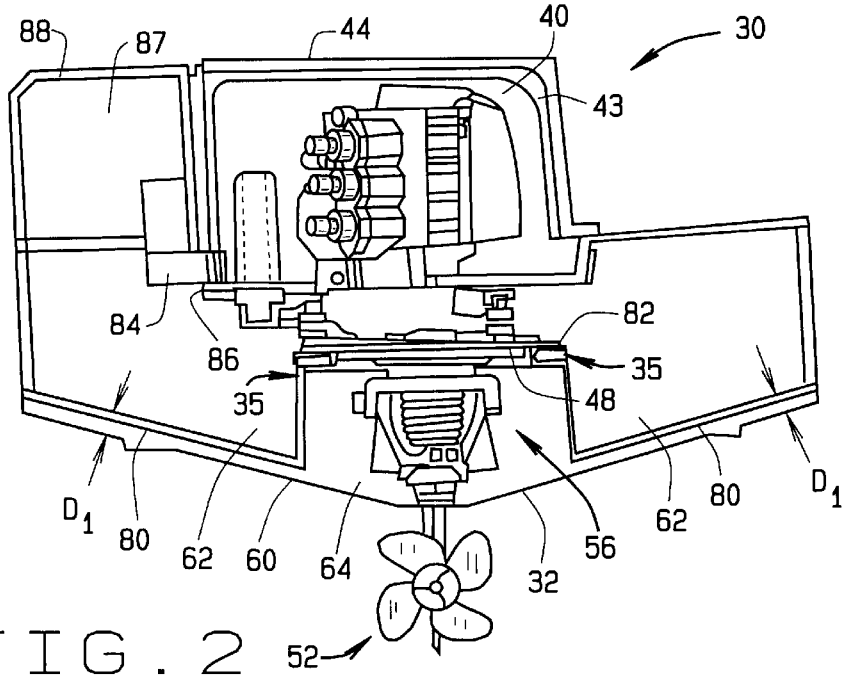
FIG. 2 is another partial cross sectional view of the watercraft shown in FIG. 1.

FIG. 2 is a partial transverse cross sectional view of watercraft 30 through engine compartment 40. Extensions 62 flank steering arm yoke and trunnion assembly 56 and each include an extension bottom surface 80 at a distance $D_1$ above hull running surface 60. Horizontal mounting plate 48 rests in a recess (not shown in FIG. 2) through a horizontal surface 82 of engine compartment 40 and is secured to platform 35 to join marine propulsion upper and lower units 42, 54. An exhaust pipe 84 extends through a side wall 86 of engine compartment 40 and exhausts combustion gases to an exhaust chamber 87 defined by an exhaust housing 88 adjacent outer engine cover 44. From exhaust chamber 87, exhaust gases are vented to the atmosphere. Hull 32 is generally V-shaped and fabricated from known materials, and deck 46 is attached to hull 32 using known techniques.

Figure 3:
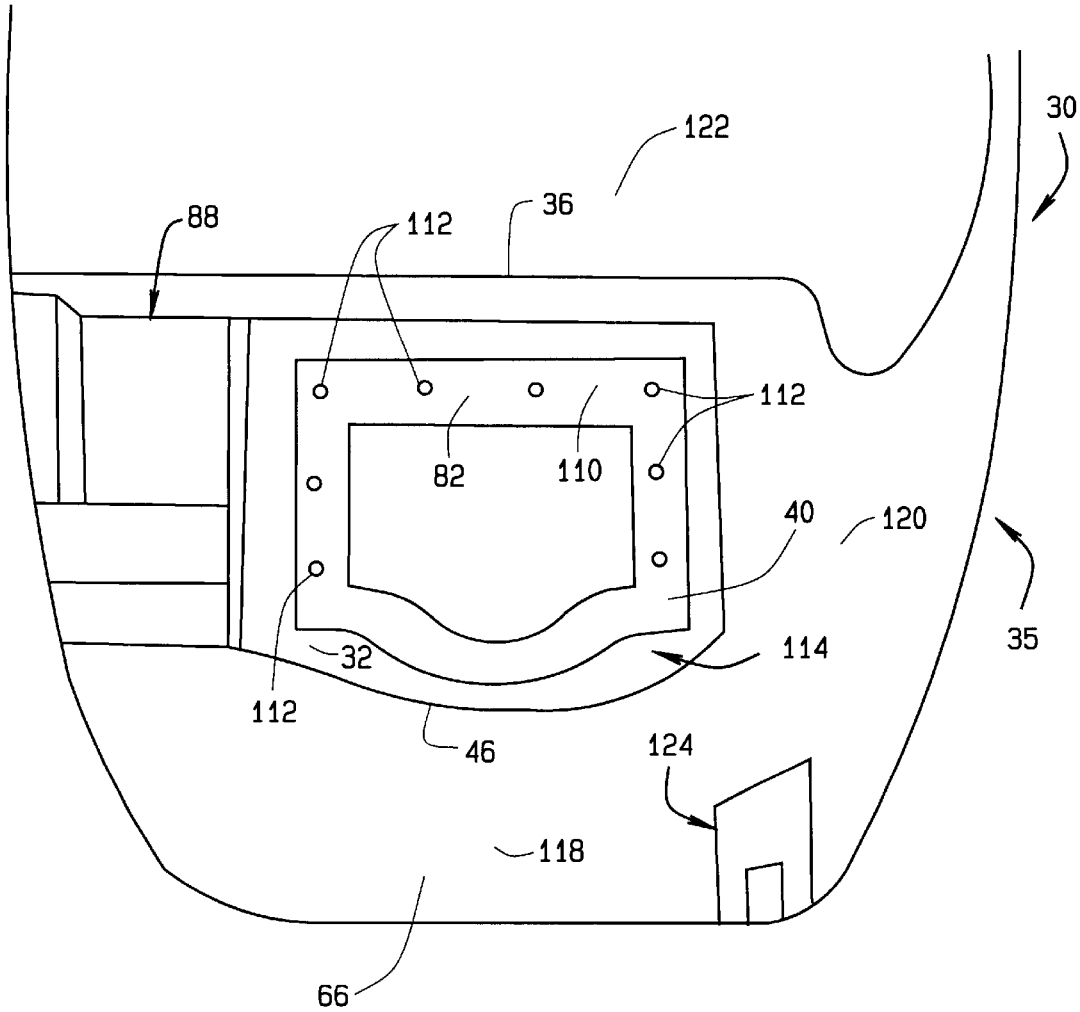
FIG. 3 is a top plan view of the watercraft shown in FIG. 3.

FIG. 3 is a partial top plan view of watercraft 30 illustrating engine compartment 40 with engine covers 43, 44 (shown in FIGS. 1 and 2) and marine propulsion system 34 (shown in FIGS. 1 and 2) removed. A shelf 110 is formed in platform 35 at an engine compartment horizontal surface 82 and includes a plurality of attachment holes 112 for securing horizontal mounting plate 48 (shown in FIGS. 1 and 2) to platform 35. A recess 114 extends through engine compartment horizontal surface 82 adjacent exhaust housing 88 and is shaped to ease installation of marine propulsion system 34. Recess 114 extends through platform 35 between extensions 62 to extension bottom surfaces 80 (shown in FIG. 2). Recess 114 is adapted to receive horizontal mounting plate 48 which is secured to platform 35 above the water line when watercraft 30 is used. Thus, upper unit 42 (shown in FIG. 1) extends upward from horizontal mounting plate 48 and lower unit 54 (shown in FIG. 1) extends downward from horizontal mounting plate 48 and into a body of water when watercraft 30 is used. Upper unit 42 is mounted stationary to horizontal mounting plate 48 while lower unit 54 is free to rotate, trim, and tilt for steering and maneuvering lower unit 54 relative to marine propulsion upper unit 42.

Ledge 66 extends rearward of engine compartment 40 and forms a surface 118 that, in one embodiment, may be padded and used as a sundeck. A watercraft interior 122 is adjacent platform 35, and watercraft interior rear end 36 (also shown in FIG. 1) is separated from platform engine compartment 40. Watercraft interior includes seats and storage space (not shown in FIG. 3). Also, in one embodiment, ledge 66 includes a molded swim ladder receptacle 124 to receive a ladder (not shown in FIG. 4) to assist users in boarding watercraft 30.

Figure 4:
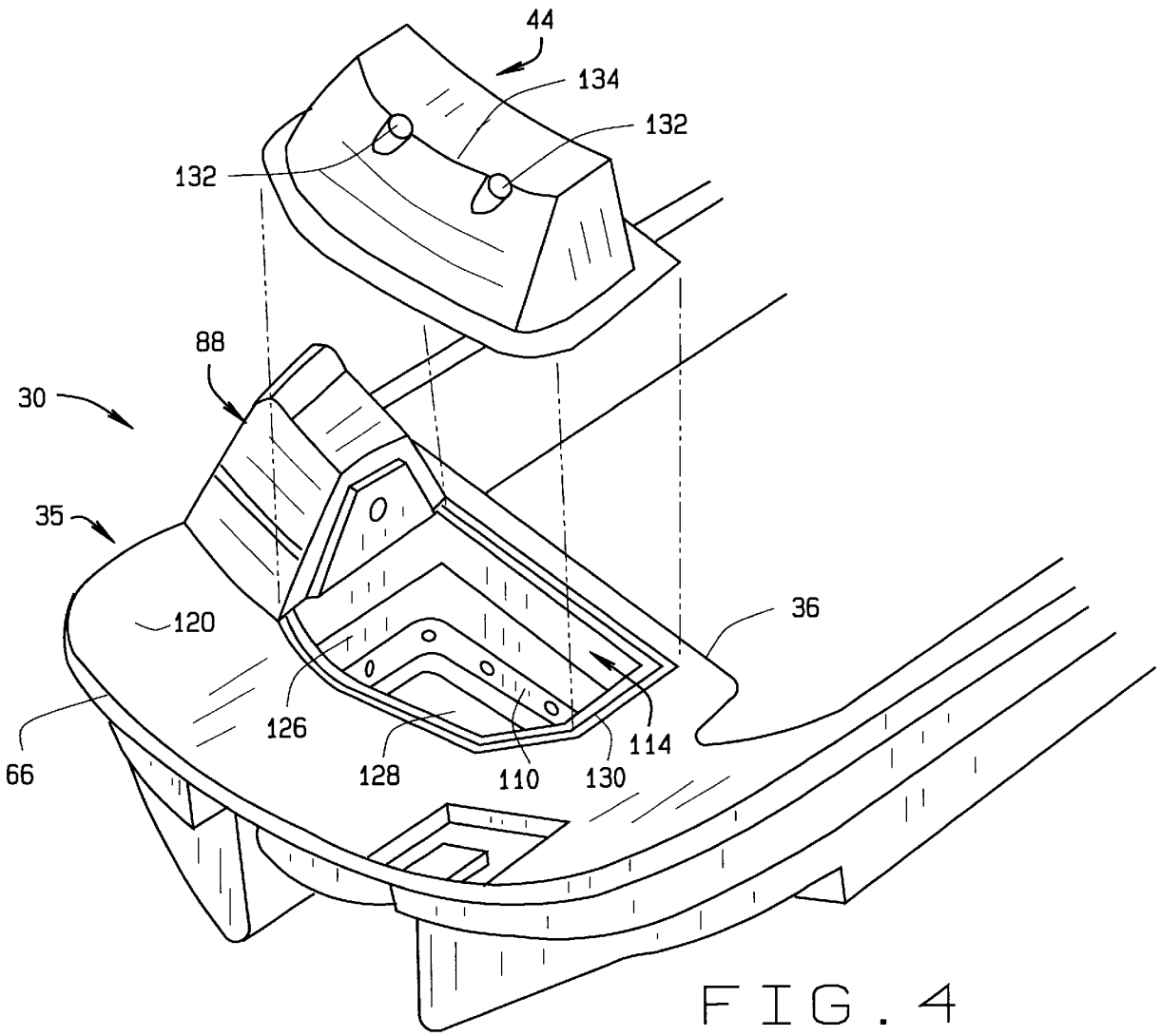
FIG. 4 is a perspective view of the watercraft shown in FIG. 1 with the marine propulsion system removed.

FIG. 4 is a perspective view of watercraft 30 with marine propulsion system removed and illustrating platform recess 114 including a top opening located above an opening 128 through platform shelf 110. Marine propulsion system lower unit 54 extends generally below platform shelf opening 128 and marine propulsion upper unit 42 extends generally above platform opening 126, and a driving transmission is established between upper and lower units 42, 54, respectively through platform shelf opening 128, as described further below. Exhaust housing 88 extends upwardly from top surface 120 of ledge 66, and outer engine cover 44 seats on a lip 130 surrounding platform opening 126 adjacent exhaust housing 88. Engine cover includes vents 132 on a rear top surface 134 to ventilate engine compartment 40 (shown in FIGS. 1 and 2).

Figure 5:
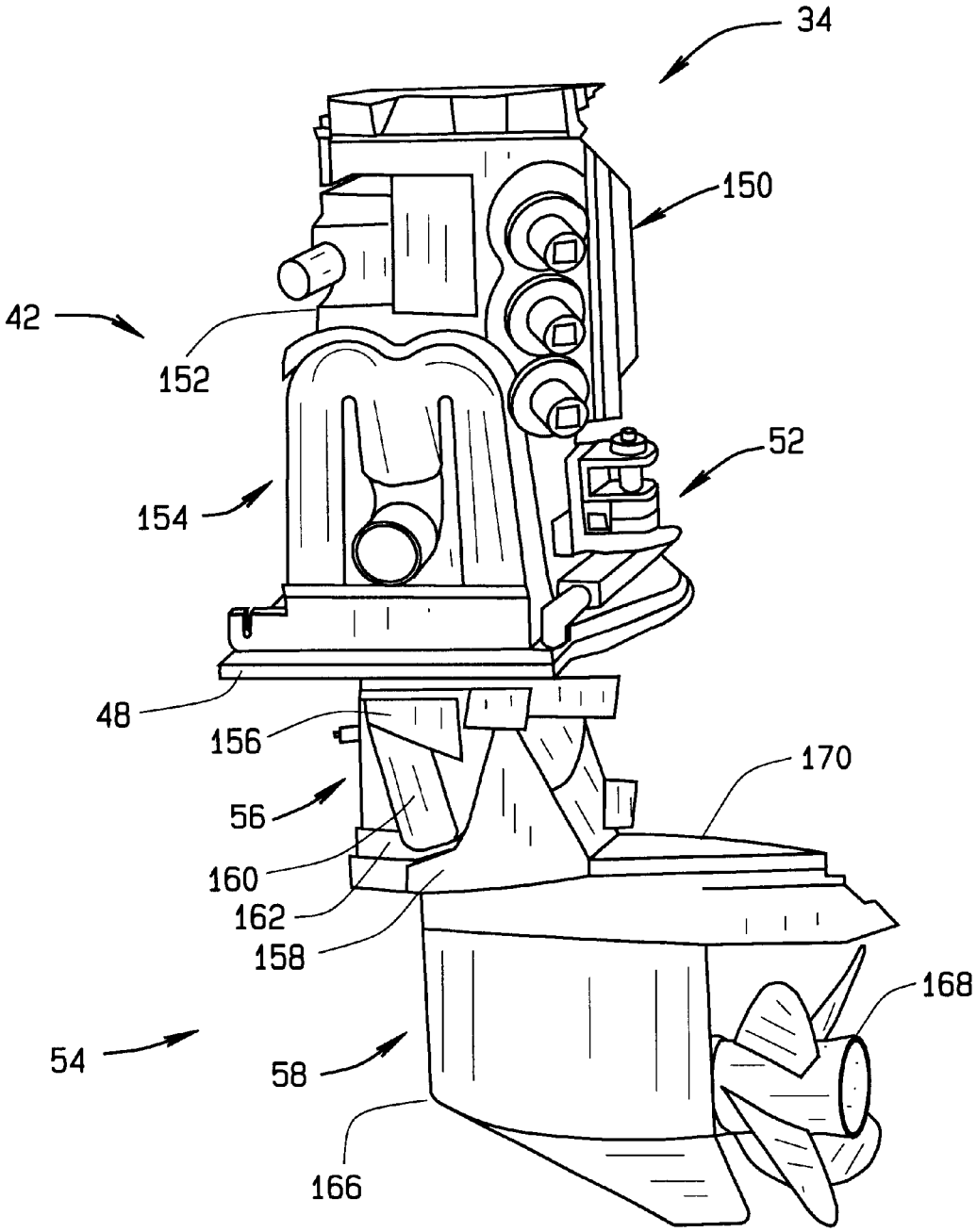
FIG. 5 is a perspective view of the marine propulsion system shown in FIG. 1.

FIG. 5 is a perspective view of marine propulsion system 34 including upper unit 42 and lower unit 54 attached to horizontal mounting plate 48. Upper unit 42 includes a conventional outboard powerhead 150 including a cylinder block 152, and exhaust system 154. In an exemplary embodiment, powerhead 150 is a two stroke EVINRUDE® outboard engine manufactured by Outboard Marine Corporation of Waukegan Ill. and includes FICHT® fuel injection technology, also of Outboard Marine Corporation, for improved engine performance with reduced hydrocarbon emissions. In alternative embodiments, other makes and models of outboard powerheads of various manufacturers, including four stroke powerheads, may be employed.

Powerhead 150 is mounted to horizontal mounting plate 48 via a mounting assembly 52, described further below, so that powerhead 150 is stationary relative to horizontal mounting plate 48. A steering arm (not shown in FIG. 5) is rotatably mounted to horizontal mounting plate 48 adjacent powerhead 150 for rotational movement relative to powerhead 150 and to horizontal mounting plate 48. The steering arm rotates about an axis (not shown in FIG. 5) perpendicular to horizontal mounting plate, i.e., about a vertical axis. Lower unit 42 includes steering arm yoke and trunnion assembly 56 including a yoke 156 that is attached to the steering arm, and a trunnion 158 attached to yoke 156. Propeller drive unit 58 is attached to steering arm yoke and trunnion assembly 56 for generating thrust to propel watercraft 30 (shown in FIGS. 1 and 2). Thus, as the steering arm rotates relative to horizontal mounting plate 48, lower unit 54 is also rotated so that watercraft 30 may be steered.

Steering arm yoke and trunnion assembly 56 also includes actuator cylinders 160 connected between yoke 156 and trunnion 158 to adjust a trim and tilt position of propeller drive unit 58 relative to stationary upper unit 42 and horizontal mounting plate 48. As a ram 162 extends and retracts in each cylinder 160, a lower unit 54 angle of inclination (see FIG. 1) measured from an axis perpendicular to horizontal mounting plate is changed to affect a required draft of watercraft 30 and operational performance of watercraft 30 under various water conditions at various speeds. A pivot pin 164 connects yoke 156 and trunnion 158 and allows lower unit 42 to pivot toward and away from hull vertical wall 64 (shown in FIG. 1) of watercraft 30 while powerhead 150 and horizontal mounting plate 48 remain stationary relative to watercraft 30.

Propeller drive unit 58 includes a gearcase 166, a propeller 168, and, in one embodiment, a removable gearcase plate 170 that greatly simplifies installation of marine propulsion system 34. Specifically, removable gearcase plate 170 eases installation, or uninstallation, of marine propulsion system 34 by allowing a pre-assembly upper unit 42, horizontal mounting plate 48 and steering arm yoke and trunnion assembly 56 to be located at least partially through platform recess 114 (shown in FIG. 3) until horizontal mounting plate 48 is received in platform recess 114. Horizontal mounting plate 48 is secured to platform 35 via shelf attachment holes 112 (shown in FIG. 3) in engine compartment horizontal surface 82 (shown in FIG. 3). Propeller drive unit 58 gearcase 166 is then attached to trunnion 158 and removable gearcase plate 170 is attached to gearcase 166. Installation is completed by making actuator, fuel, electrical, and control system connections.

In an alternative embodiment, gearcase plate 170 is fixed to drive unit 58, and propulsion system installation is further simplified. Marine propulsion system upper and lower units, 42, 54, including outboard powerhead 150, mounting assembly 52, steering arm yoke and trunnion assembly 56, and drive unit 58, are fully pre-assembled and tested, and the assembly is lowered through engine compartment recess 114 (shown in FIGS. 3 and 4). Mounting assembly 52 is then secured horizontally to platform 35 (shown in FIGS. 1 and 2). Marine propulsion system installation is completed by making hydraulic connections for trim, tilt, and steering of propeller drive unit 58, and by making appropriate fuel, electrical and control system connections to the various components of propulsion system 34.

Figure 6:
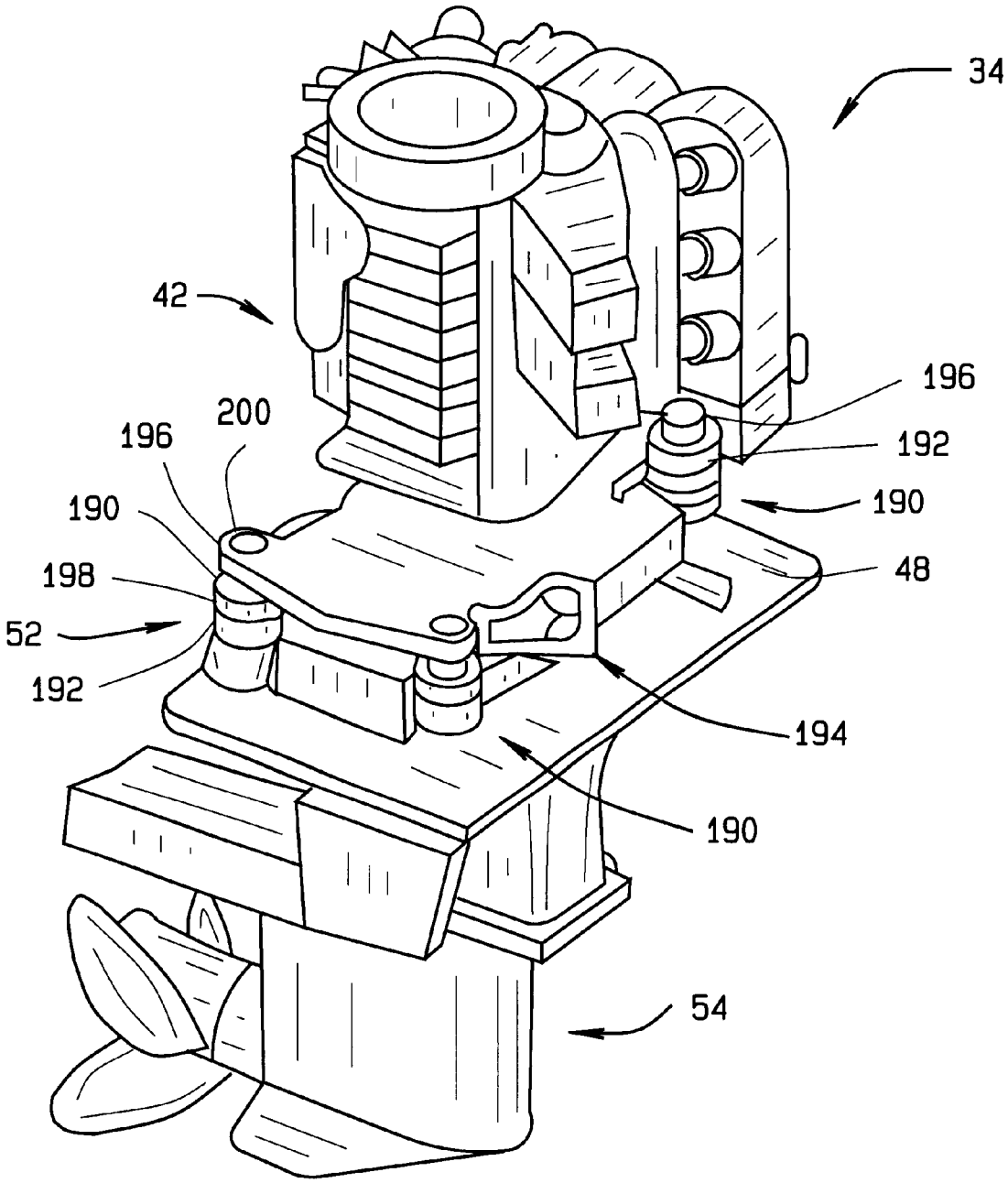
FIG. 6 is another perspective view of the propulsion system shown in FIG. 5 illustrating a mounting assembly.

FIG. 6 is another perspective view of marine propulsion system 34 illustrating mounting assembly 52 that fastens upper unit 42 to horizontal mounting plate 48. Mounting assembly 52 includes a plurality of isolation points 190 to absorb vibration of propulsion system 34 in use. In a particular embodiment, mounting assembly 52 includes four isolation points 190 to absorb vibration of propulsion system 34. A pivot housing 192 houses steering arm 194 to rotate lower unit 54 about an axis (not shown in FIG. 6) perpendicular to horizontal mounting plate 48, and is mounted to horizontal mounting plate 48 at isolation points 190. An adapter plate 196 is connected to powerhead 150 and is also mounted to horizontal mounting plate 48 at isolation points 190. At each isolation point 190, pivot housing 192 is flanked by a drive mount 198, and adapter plate 196 is flanked by an engine mount 200. Drive mounts 198 and engine mounts 200 are isolated from one another in mounting assembly 52 to minimize transmission of vibration between upper and lower units 42, 54, as further described below.

Figure 7:
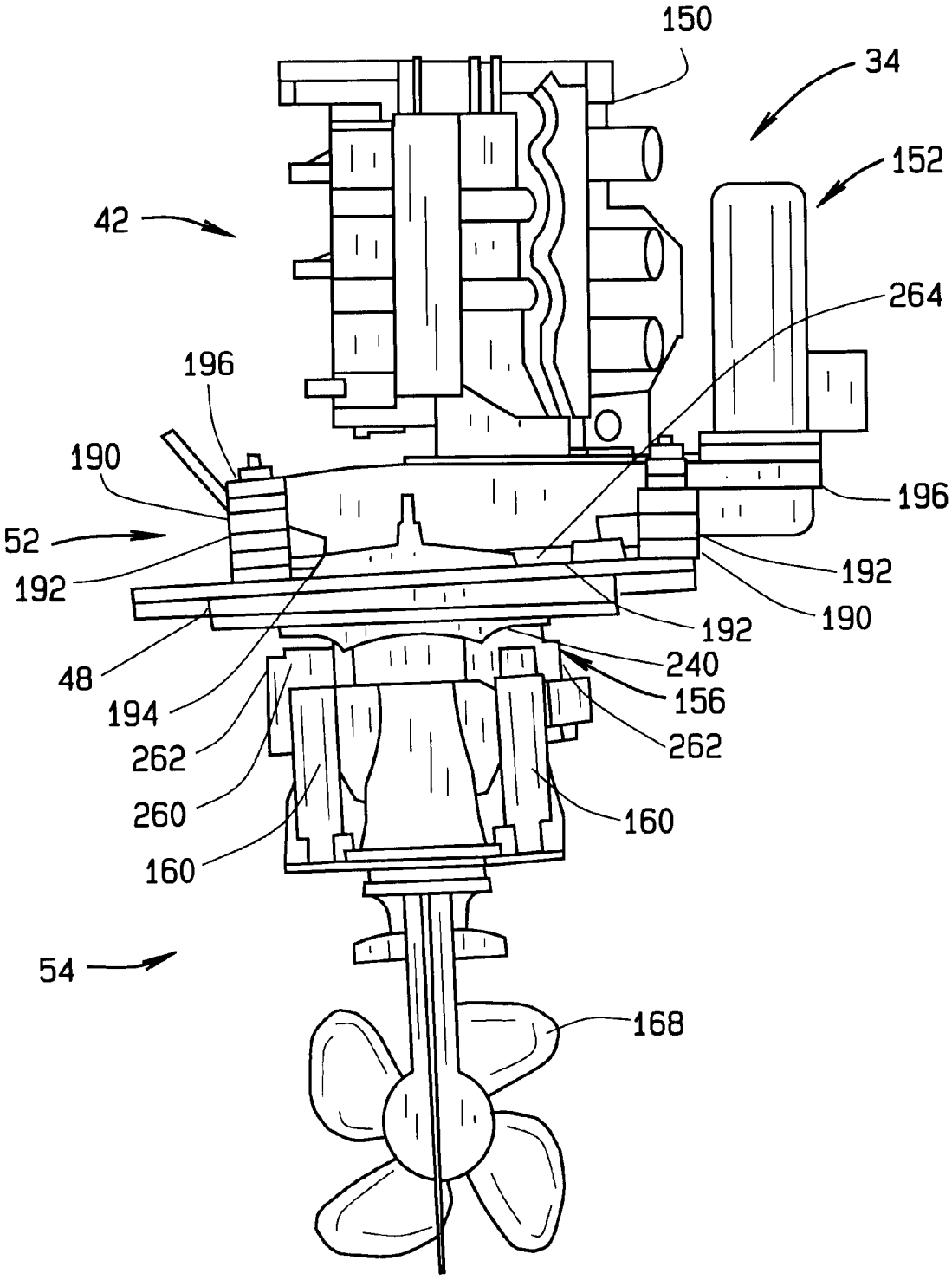
FIG. 7 is a front elevational view of the propulsion system shown in FIG. 5.

FIG. 7 is a rear elevational view of propulsion system 34 illustrating mounting assembly 52 and attachment of upper and lower units 42, 54 to horizontal mounting plate 48. Pivot housing 192 rests upon horizontal mounting plate 48 and supports steering arm 194 so that steering arm 194 is substantially centered with respect to horizontal mounting plate 48, and off-centered with respect to pivot housing 192. Steering arm 194 is supported by a bearing surface (not shown in FIG. 7) that allows rotation of steering arm 194 about a vertical axis (not shown in FIG. 7) perpendicular to horizontal mounting plate 48. Steering arm 194 is coupled to a watercraft input (not shown in FIG. 7), such as a steering wheel, for rotation in response to operator input according to conventional methods. As steering arm 194 rotates, the orientation of lower drive unit 42, and especially propeller 168, relative to watercraft 30 shown in FIGS. 1 and 2) is changed, allowing an operator to steer watercraft 30.

Yoke 156 includes a drum (not shown in FIG. 7) that extends through horizontal mounting plate 48 and attaches to steering arm 194 in a manner described below. A yoke connector portion 240 extends from the yoke drum and is connected to a yoke pivot arm 260 that allows a remainder of lower unit 42 to pivot about a pivot pin 262 in response to operation of actuator cylinders 160. Therefore, adjustment of a trim and tilt position of lower unit 54 relative to stationary upper unit 42 may be accomplished. In an exemplary embodiment, actuator cylinders 160 are hydraulic cylinders including rams 162 (shown in FIG. 5) that extend and retract within cylinders 160 to change a trim and tilt position of lower unit 54 with respect to stationary upper unit 42.

Unlike generally symmetrical lower unit 54, upper unit 42 is asymmetrical and longitudinally displaced from lower unit 54. Powerhead 150 and exhaust system 154 are attached to adapter plate 196, and adapter plate 196 is attached to isolation points 190 to provide a clearance 264 between pivot housing 192 and adapter plate 196 for steering arm 194 to move freely on a bearing surface (not shown in FIG. 7). A powerhead output shaft (not shown in FIG. 7) extends from powerhead 150 through adapter plate 196, through steering arm 194 and through the yoke drum extending through horizontal mounting plate 48. A universal joint (not shown in FIG. 7) is connected between a yoke pivot arm 260 and gearcase 166 as further described below to impart rotary motion to propeller 168 regardless of a trim and tilt position of lower unit 54.

Figure 8:
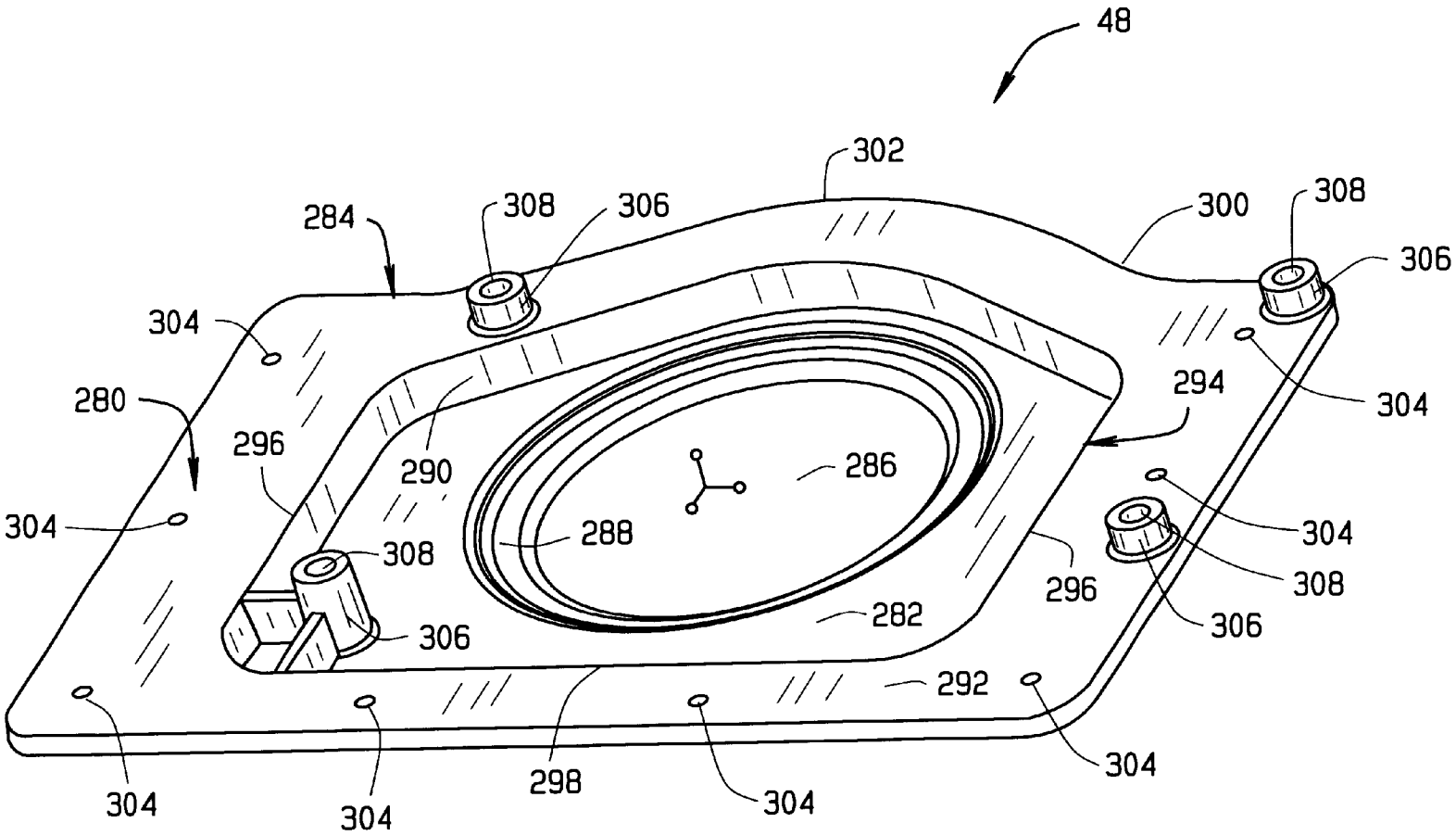
FIG. 8 is a perspective view of a mounting assembly horizontal mounting plate.

FIG. 8 is a top perspective view of horizontal mounting plate 48 including a shoulder 280 that rests upon platform engine compartment shelf 110 (shown in FIG. 3) and a recessed surface 282 that is received by engine compartment recess 114 (shown in FIG. 3). Recessed surface 282 is approximately centered within an outer periphery 284 of shoulder 280 and includes a central opening 286 therethrough including a seal ledge 288 around a circumference thereof. Opening 286 is dimensioned to accommodate steering arm yoke and trunnion assembly 56 (shown in FIG. 5).

A vertical wall 290 extends from horizontal recessed surface 282 to a top surface 292 of shoulder 280 and forms an outer periphery 294 of recessed portion including two straight and parallel sides 296 of approximately equal length, a straight side 298 substantially perpendicular to parallel sides 296 and having a greater length than parallel sides, and a contoured side 300. Contoured side 300 is generally perpendicular to parallel sides 296 as they approach one another and is curved outward and away from central opening 286 to form a convex curved segment 302 approximately centered on contoured side 300. Shoulder outer periphery 284 is substantially identical and generally parallel to recessed portion outer periphery 294 but of a larger dimension.

A plurality of attachment holes 304 extend through shoulder 280 so that horizontal mounting plate 48 may be attached to platform engine compartment shelf 110 via shelf attachment holes 112 (shown in FIG. 3). Threaded mount bases 306 extend from respective surfaces 282, 292 of horizontal mounting plate 48 and include mount openings 308 for receiving an attachment member (not shown in FIG. 8). When horizontal mounting plate shoulder 280 is attached to platform engine compartment shelf 110 (shown in FIG. 3), mount bases 306 anchor mount assembly 52 (shown in FIG. 7) components to horizontal mounting plate 48. While in an exemplary embodiment four mount bases 306 are used for four point engine mounting isolation, described further below, greater or fewer number of mount bases 306 could be used in alternative embodiments to increase or decrease the number of isolation points.

Figure 9:
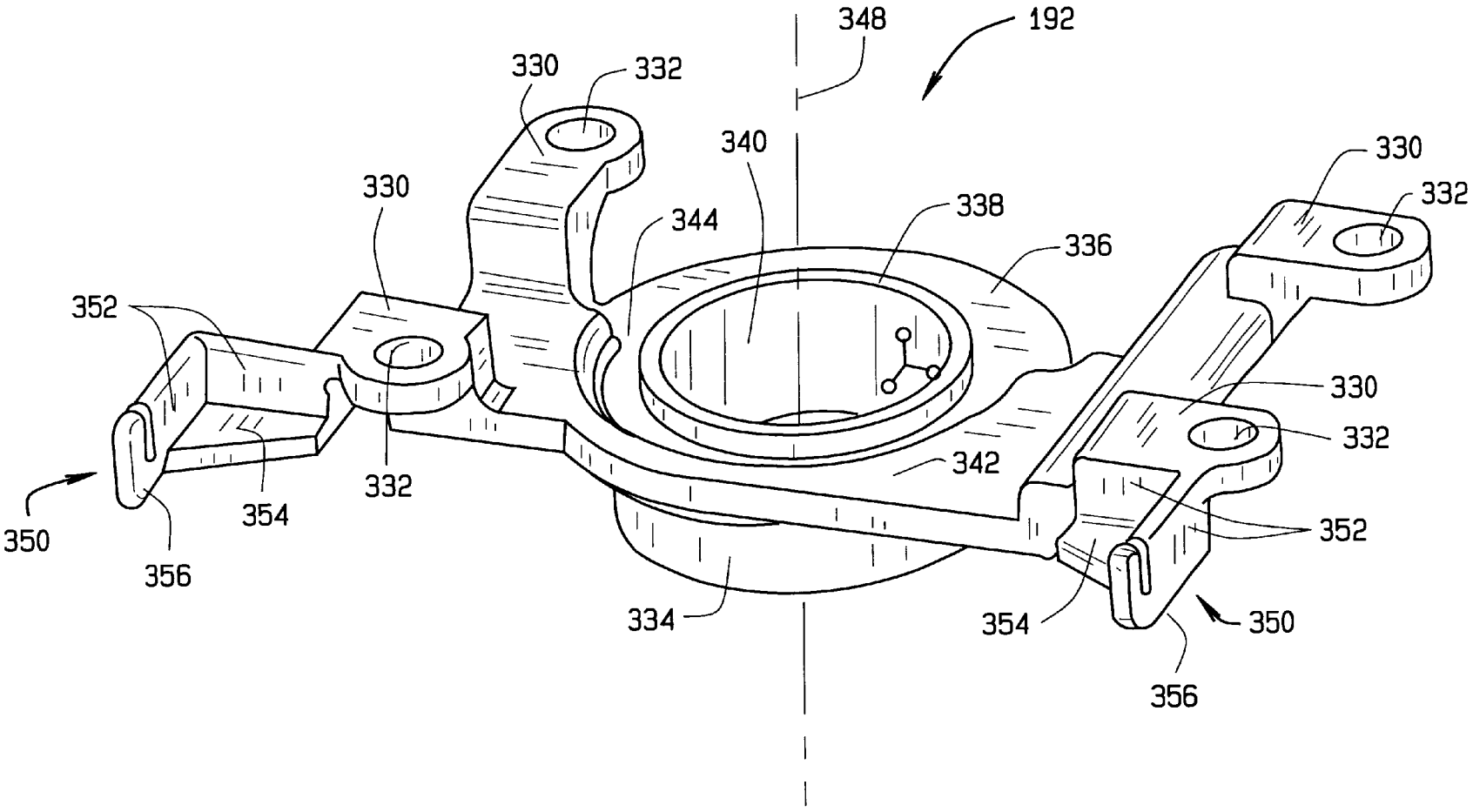
FIG. 9 is a perspective view of amounting assembly pivot housing.

FIG. 9 is a perspective view of pivot housing 192 including a plurality of mount brackets 330 including mount openings 332 for alignment with horizontal mounting plate mount bases 306 (shown in FIG. 8). Mount brackets 330 depend from a central outer drum 334 having a ring surface 336 including a raised slot 338 around a central opening 340 therethrough. Outer drum 334 extends below ring surface 336 and mounting brackets 330 and is received in horizontal mounting plate central opening 286 (shown in FIG. 8) when pivot housing 192 is attached to horizontal mounting plate 48. A raised surface 342 extends above ring surface 336 between mounting brackets 330 and forms a semicircular groove 344 between raised surface 342 and raised slot 338 for receiving steering arm 194 (shown in FIG. 6 and further described below) and allowing steering arm 194 to rotate about a longitudinal axis 348 through pivot housing central opening 340 upon a bearing surface (not shown).

Mount brackets 330 include mount openings 332 and extend upward from raised surface 342 to provide a clearance (not shown in FIG. 7) in which steering arm 194 may freely rotate. A pair of support brackets 350 extend below raised surface 342 adjacent two of the four mounting brackets 330. Each support bracket 350 includes two substantially vertical walls 352 oriented perpendicularly to one another and joined by a gusset 354 adjacent a bottom edge 356 of vertical walls 352. Gusset 354 and bottom edges 356 rest upon horizontal mounting plate shoulder 280 (shown in FIG. 8) when mounting assembly 52 (shown in FIG. 6) is assembled.

Figure 10:
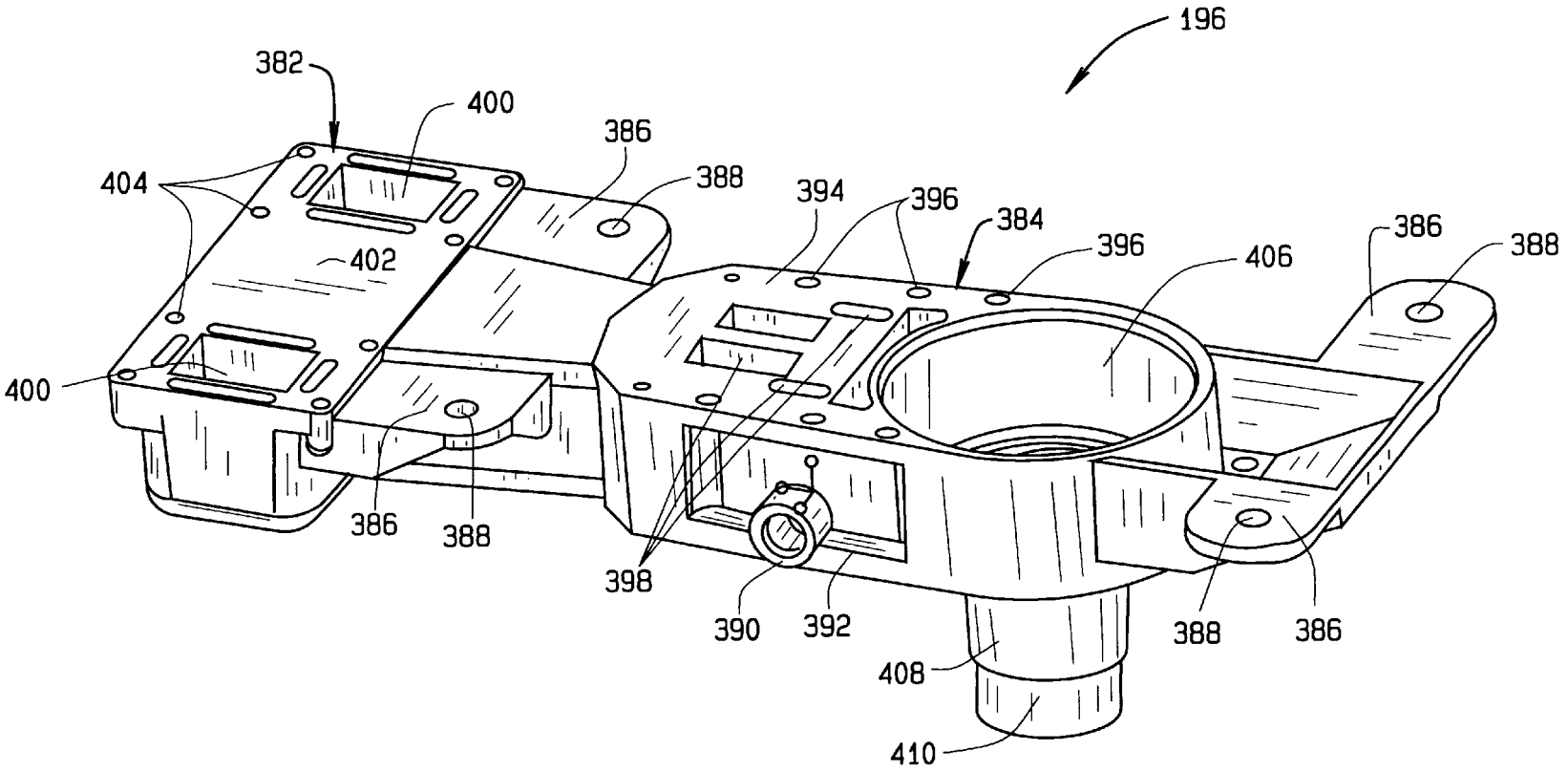
FIG. 10 is a perspective view of a mounting assembly adapter plate.

FIG. 10 is a perspective view of adapter plate 196 including an exhaust mount portion 382, a powerhead mount portion 384, and mount brackets 386 including mount openings 388 extending therefrom for alignment with pivot housing mount brackets 330 (shown in FIG. 9). A fluid path inlet 390 extends from a side plate 392 and is adapted for attachment to a fluid member (not shown), such as a hose, for delivery of cooling water to powerhead 150 (shown in FIG. 5) that is attached to a top surface 394 of powerhead mount portion 384 via attachment openings 396 therethrough. A plurality of fluid passages (not shown) fluidly communicate with fluid path inlet 390 and circulate cooling water to and from respective ports (not shown) in powerhead 150 through fluid passage openings 398 in powerhead mount portion top surface 394. Cooling water is also channeled to exhaust mount portion 382 through adapter plate 196 and is mixed with exhaust gases via exhaust water ports 400 in an exhaust mount top surface 402 that is attached to exhaust system 154 (shown in FIG. 5) via attachment openings 404 therethrough.

Powerhead mount portion 384 includes a central opening 406, and first and second drums 408, 410 extending therefrom below side plate 392. Telescoping drums 408, 410 extend through pivot housing central opening 340 when mounting assembly 52 (shown in FIG. 6) is assembled. An output drive shaft (not shown) of powerhead 150 (shown in FIG. 5) extends through telescoping drums 408, 410 and bearings (not shown) are retained in central opening 406 to facilitate driving transmission of powerhead 150 through mounting assembly 52 (shown in FIG. 6).

Figure 11:
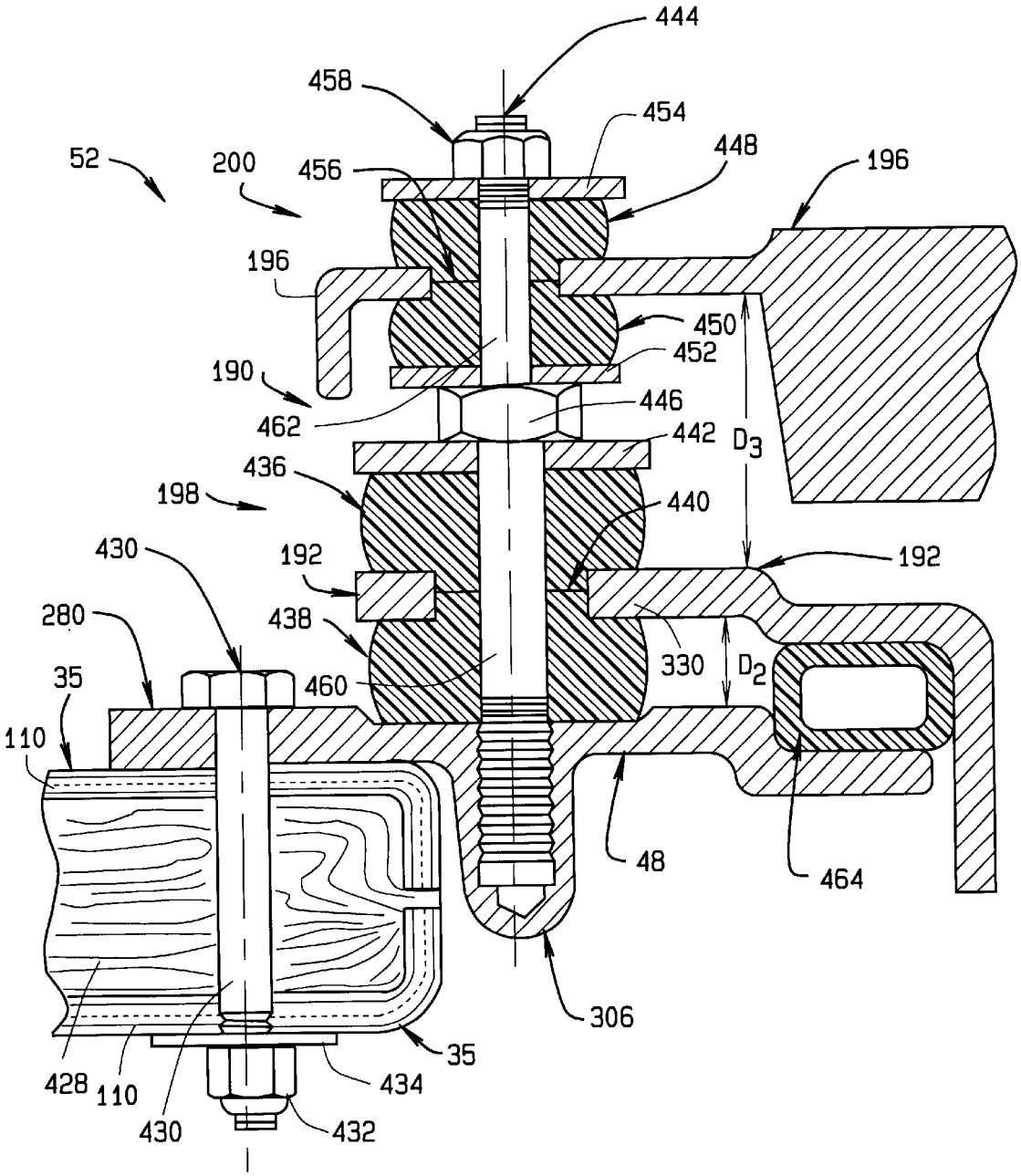
FIG. 11 is a partial cross sectional view of the mounting assembly shown in FIG. 6.

FIG. 11 is a partial cross sectional view of mounting assembly 52 through one of isolation points 190 schematically illustrating the connection of pivot housing 192 and adapter plate 196 to horizontal mounting plate 48, and the connection of horizontal mounting plate 48 to watercraft platform 35 through a structural support material 428. In various embodiment, structural support material 428 is a known material for adding strength and rigidity to the connection, such as, for example, structural foam, wood, renwood, or an aluminum plate. Horizontal mounting plate shoulder 280 rests upon platform engine compartment shelf 110. A bolt 430 extends through aligned attachment openings 304, 112 (shown in FIGS. 7 and 3, respectively) of horizontal mounting plate shoulder 280 and platform shelf 110, respectively. A nut 432 and washer 434 securely fasten horizontal mounting plate 48 to platform shelf 110.

In various alternative embodiments, it is contemplated that horizontal mounting plate 48 be attached to watercraft deck 46 and/or hull 32 (shown in FIGS. 1 and 2) instead of the above-described attachment to platform engine compartment shelf 110. For example, in one alternative embodiment, horizontal mounting plate 48 is positioned between generally parallel and proximally located portions of deck 46 and hull 32 and secured by fasteners extending through deck 46, hull 32, and horizontal mounting plate 48. In still other alternative embodiments, horizontal mounting plate 48 is integrally formed into deck 46, hull 32, platform 35 and/or combinations thereof in interior or exterior engine compartments or recesses. Therefore, horizontal mounting plate 48 may be secured to watercraft 30 (shown in FIG. 1) in numerous ways, and the invention is not limited to a specific attachment of horizontal mounting plate 48 to watercraft 30, such as that shown in FIG. 11.

Drive mount 198 includes substantially circular upper and lower drive mount segments 436, 438 aligned with horizontal mounting plate mount base 306. Upper and lower drive mount segments 436, 438 include stepped crowns 440 that together encapsulate pivot housing 192 around pivot housing mount brackets 330 at a distance $D_2$ above horizontal mounting plate 48. A drive mount washer 442 is located atop upper drive mount segment 436, and a threaded mount stud fastener 444 extends through upper and lower drive mount segments 436, 438 and is fastened to threaded horizontal mounting plate mount base 306. A nut mount stud 446 is attached to mount stud 444 adjacent drive mount washer 442, and engine mount 200 includes substantially circular upper and lower engine mount segments 448, 450 positioned between a lower engine mount washer 452 adjacent nut mount stud 446 and an upper engine mount washer 454. Upper and lower engine mount segments 448, 450 include stepped crowns 456 that together encapsulate adapter plate 196 around adapter plate mount brackets 386 at a distance $D_3$ above pivot housing 192. A nut 458 is attached to mount stud 444 adjacent upper engine mount washer 454 and anchors mounting assembly 52 to horizontal mounting plate 48.

Mounting stud 444 includes a first portion 460 of a first diameter that attaches to horizontal mounting plate mount base 306 and a second portion 462 of a second diameter extending from first portion 460. The first portion diameter is greater than the second portion diameter, and first and second portions 460, 462 are separated by nut mount stud 446. Upper and lower drive mount segments 436, 438 and upper and lower engine mount segments 448, 450 are fabricated from rubber and absorb vibration of pivot housing 192 and adapter plate 196, respectively. A rubber seal 464 seats upon horizontal mounting plate seal ledge 288 to prevent water from splashing into engine compartment 42 between horizontal mounting plate 48 and pivot housing 192.

Figure 12:
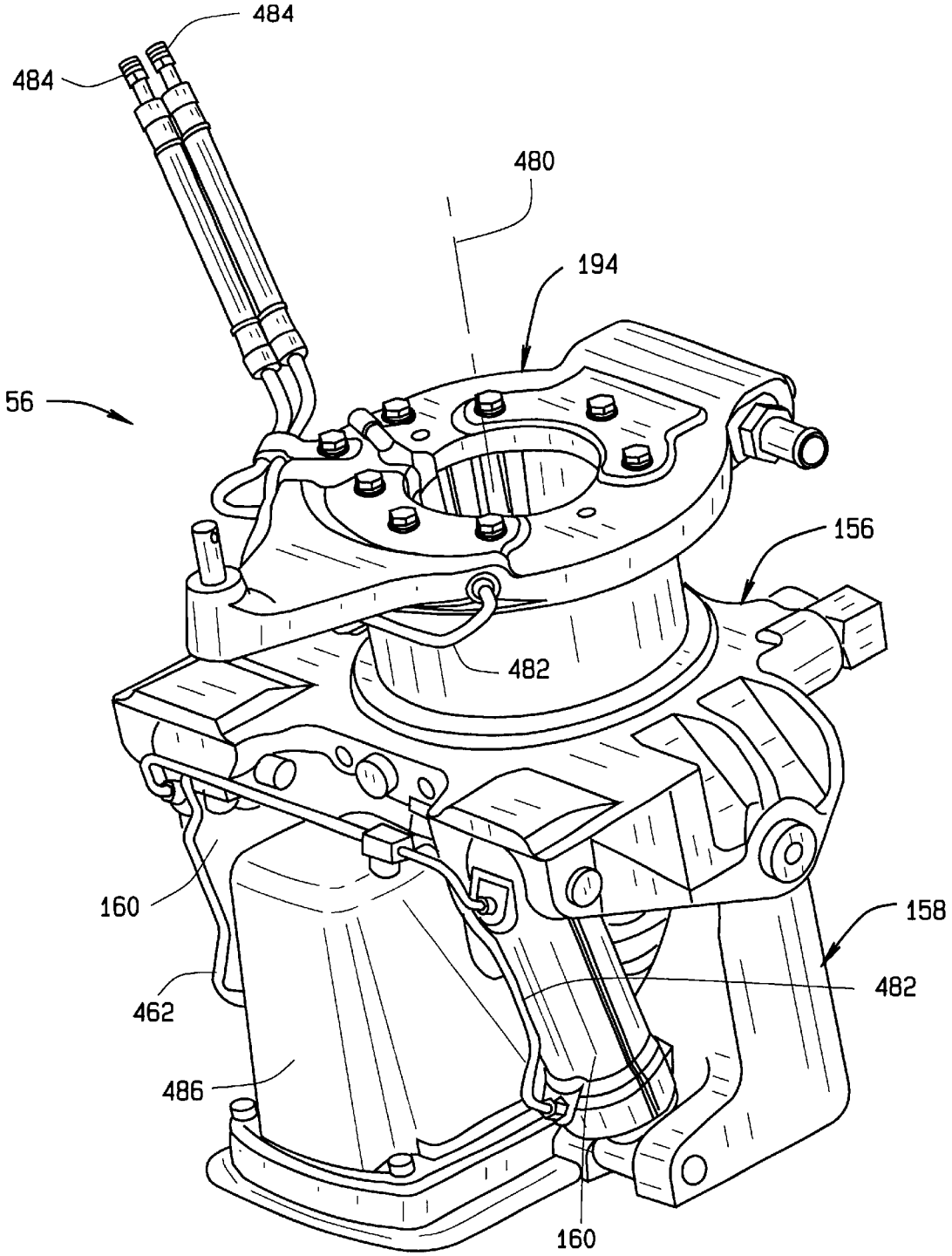
FIG. 12 is a perspective view of a steering arm yoke and trunnion assembly for the propulsion system shown in FIG. 5.

FIG. 12 is a perspective view of steering arm yoke and trunnion assembly 56 including steering arm 194, yoke 156, trunnion 158 and actuator cylinders 160. Steering arm yoke and trunnion assembly 56 is rotatable about longitudinal axis 480 and is pivotable relative to longitudinal axis 480 to adjust the orientation of attached propeller drive unit 58 (shown in FIG. 5) relative to watercraft 30 (shown in FIGS. 1 and 2) to maneuver watercraft 30. Steering arm 194 is rotated upon a bearing surface (not shown) about longitudinal axis 480 via a mechanical linkage (not shown) coupled to an operator input (not shown) such as a steering wheel. In a particular embodiment, actuator cylinders 160 include rams 162 (not shown in FIG. 12) coupled to actuator fluid lines 482. Fluid lines 482 are connected to fluid passages (not shown in FIG. 12) through steering arm 194 and yoke 156 to complete a fluid circuit (not shown) through cylinders 160 when actuator system connections 484 extending from steering arm 194 are connected to an actuating system (not shown), such as, for example, a hydraulic system. Coolant water fluid paths (not shown in FIG. 12) also extend through yoke 156 and steering arm to deliver cooling water to powerhead 150 (shown in FIG. 5) regardless of the relative orientation of marine propulsion system upper and lower units 42, 54, respectively.

A gear shift cover 486 attached to trunnion 158 houses an electric gear shift assembly (not shown in FIG. 12) for reversing a direction of rotation of propeller drive unit 58 (shown in FIG. 5) and hence reversing a direction of thrust of marine propulsion system 34 (shown in FIG. 5).

Figure 13:
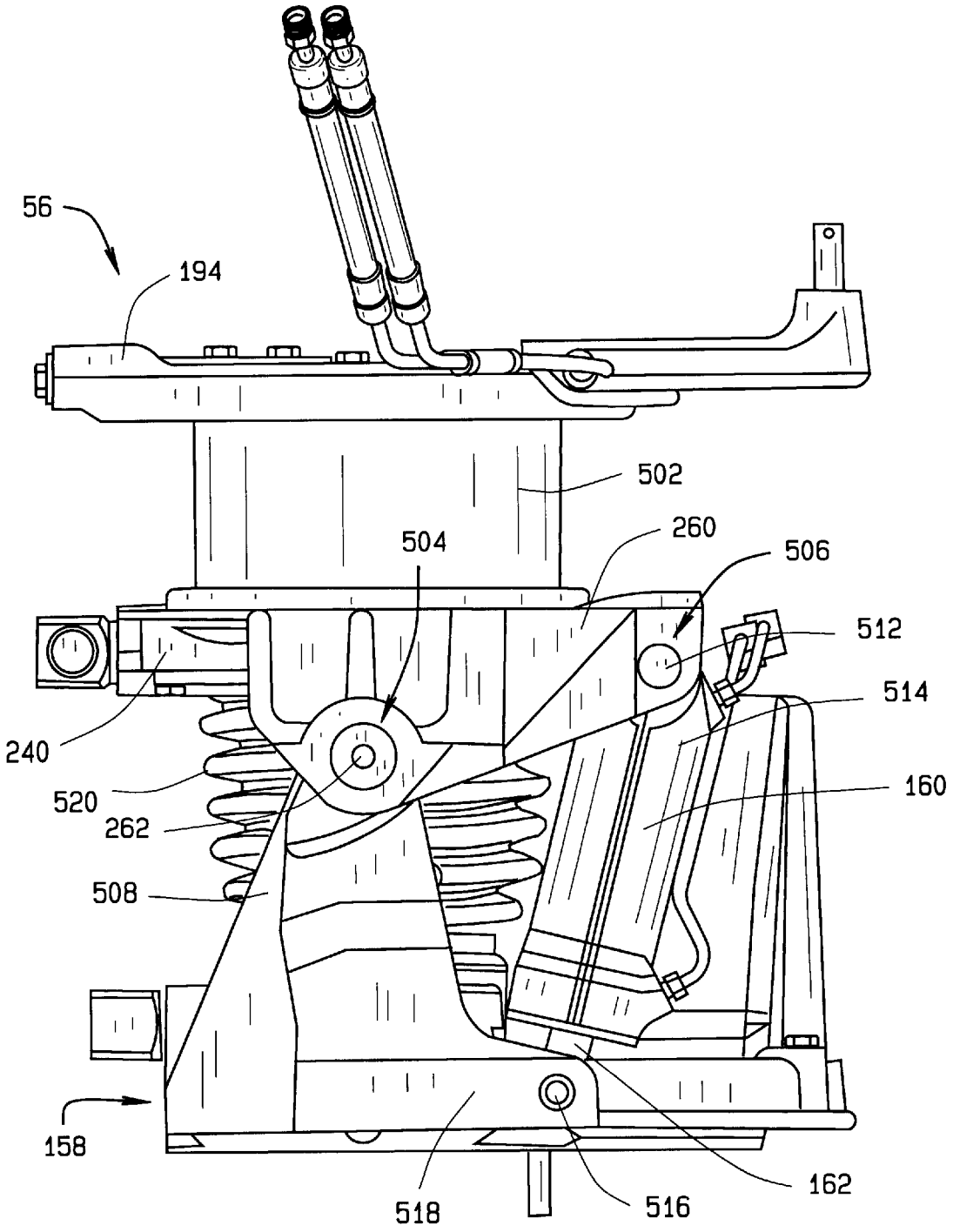
FIG. 13 is a side elevational view of the steering arm yoke and trunnion assembly shown in FIG. 12 in fill tilt down position.

FIG. 13 is a side elevational view of steering arm yoke and trunnion assembly 56 in a full tilt down position. Yoke drum 502 is connected to steering arm 194, and yoke pivot arm 260 extends from yoke drum 502. Pivot arm 260 includes a pivot connection 504 and an actuator connection 506. Pivot pin 262 extends through pivot connection 504 and pivotally connects an upper extension 508 of trunnion 158 to yoke pivot arm pivot connection 504. A first actuator pin 512 extends through actuator connection 506 for mounting a first end 514 of actuator cylinder 160 to yoke pivot arm actuator connection 506. A second actuator pin 516 connects cylinder ram 162 to a lower extension 518 of trunnion 158.

A corrugated bellows 520 extends from yoke connector portion 240 to a center portion (not shown in FIG. 13) of trunnion 158. Bellows 520 flexes around a universal joint (not shown) inside bellows 520 to accommodate an angle of inclination (not shown in FIG. 13) relative to steering arm and yoke longitudinal axis 480, or axis of rotation. A powerhead output drive shaft (not shown) extends through yoke drum 502 to an upper universal joint, which imparts rotary motion to a lower universal joint via a central universal joint inside bellows 520. Lower universal joint is coupled to a gearcase drive shaft (not shown) that drives a gear set (not shown) inside gearcase 166 (shown in FIG. 5) attached to trunnion 158.

Figure 14:
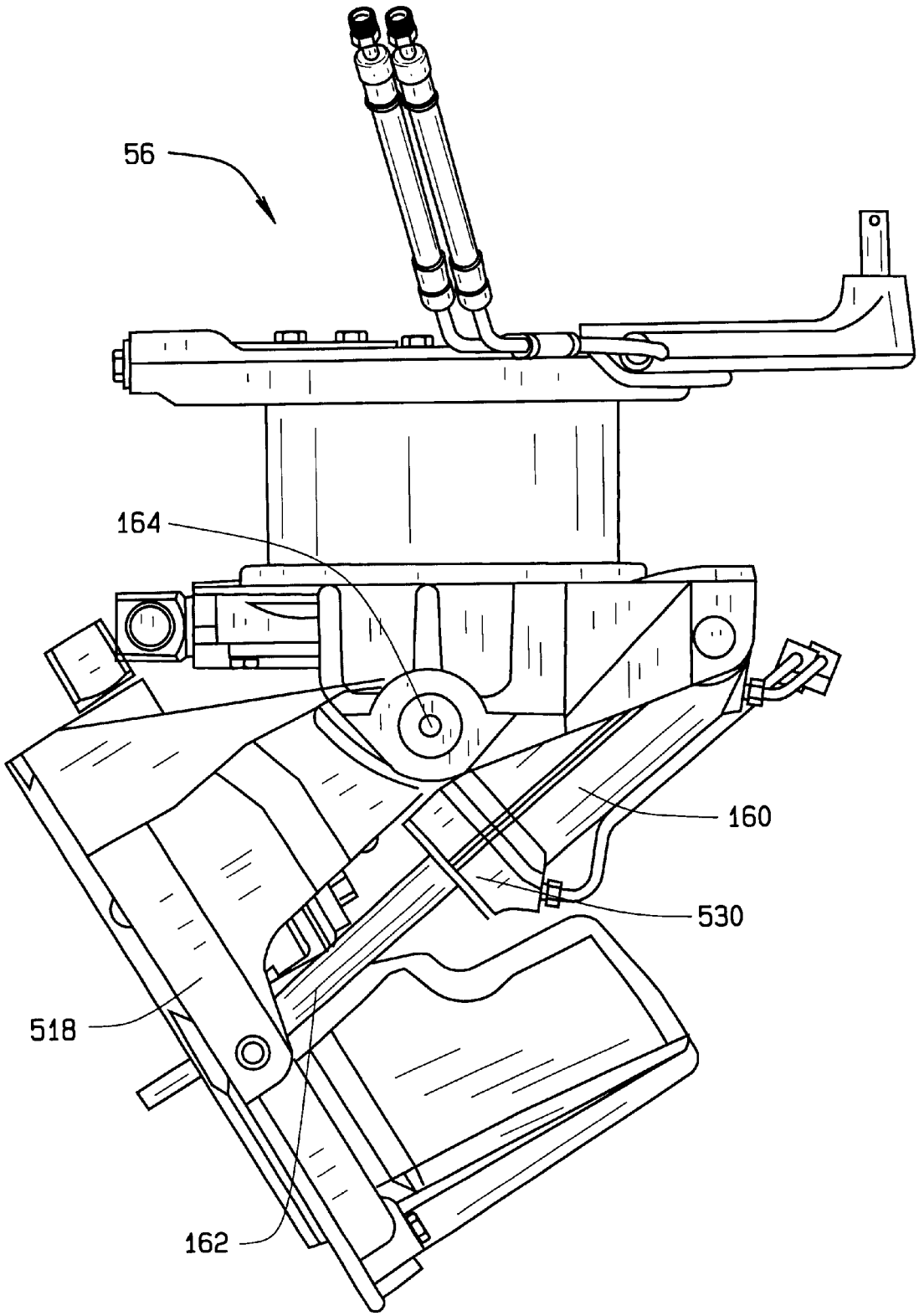
FIG. 14 is a view similar r to FIG. 12 with parts removed and the steering arm yoke and trunnion assembly in a full tilt up position.

FIG. 14 illustrates steering arm yoke and trunnion assembly 56 with parts removed and in a full tilt up position. Cylinder rams 162 are extended from an actuator end 530 of cylinders 160, thereby separating an actuator end 530 of cylinders 160 and trunnion lower extension 518. Therefore, trunnion 158 pivots about pivot pins 164 and creates an angle of inclination between stationary yoke 156 and steering arm 194 and pivoted trunnion 158. Of course, actuator cylinders 160 can be manipulated to vary steering arm yoke and trunnion assembly 56 to any desired position between fill tilt down position (shown in FIG. 13) and full tilt up position (shown in FIG. 14).

Figure 15:
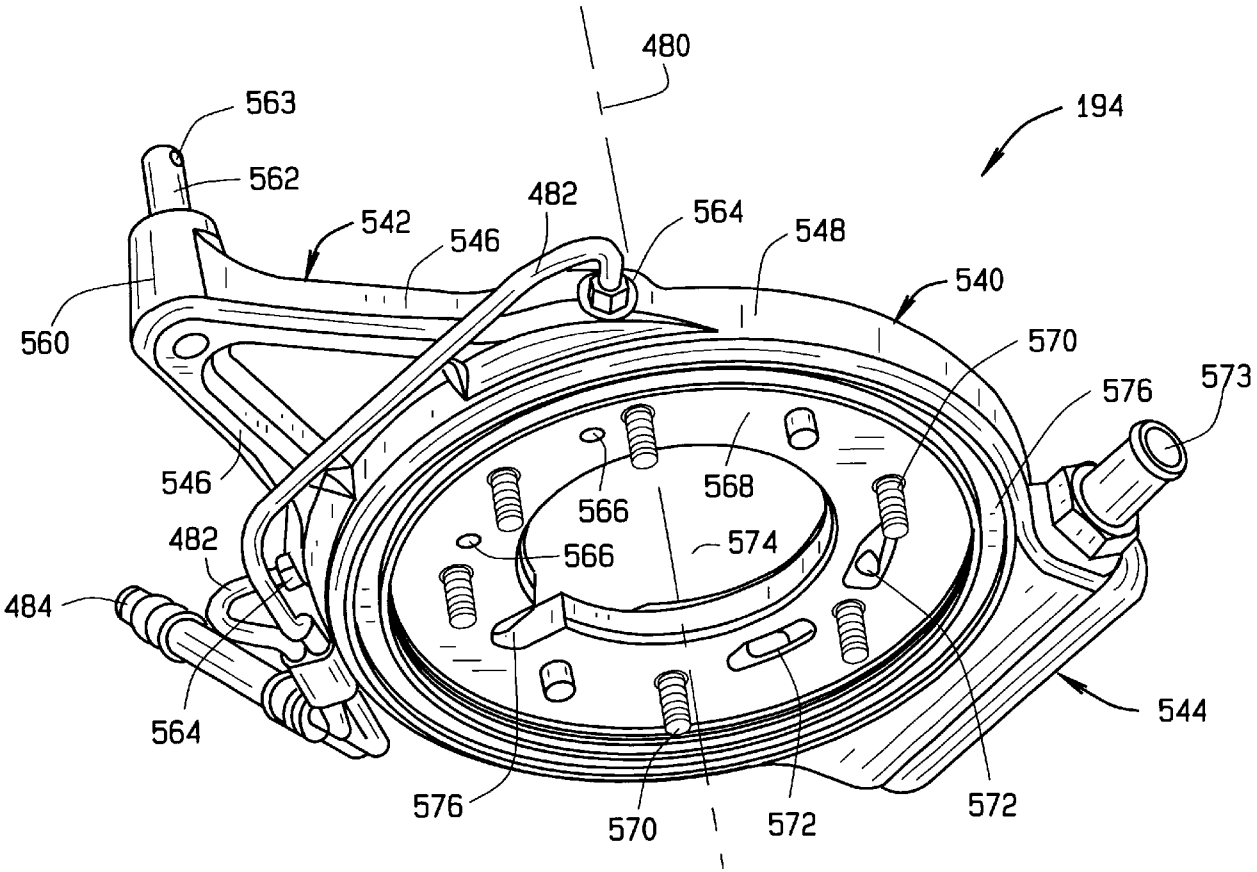
FIG. 15 is a bottom perspective view of the steering arm shown in FIGS. 12–14.

FIG. 15 is a bottom perspective view of steering arm 194 including a generally circular member 540, a lever member 542 and a counterbalance member 544. Lever member 542 includes a pair of arms 546 extending from an outer edge 548 of circular member 540 and culminating at a branch 560. A shaft 562 extends upward from branch 540 and includes an opening 563 therethrough for pin connection to a mechanical linkage (not shown) that imparts force to lever member 542 and causes steering arm 194 to rotate about longitudinal axis 480 in response to operator input. Counterbalance member 544 balances lever member 542 so that steering arm 194 freely rotates on a bearing surface (not shown).

Each lever arm 546 includes a fluid connection 564 in fluid communication with fluid paths 566 in an annular portion 568 of circular member 540. Fluid lines 482 are coupled to fluid connections 564 for delivering actuating fluid, such as hydraulic fluid, to and from actuator system connections 484. A plurality of removable attachment members 570 extend through annular portion 568 for fastening to yoke 158 (shown in FIGS. 11–13). A pair of cooling water inlets 572 extend through annular portion 568 and are in fluid communication with a cooling water outlet 573 that extends from counterbalance member opposite lever arms 546. A fluid member (not shown), such as a hose, connects steering arm outlet 573 to adapter plate inlet 390 Substantially circular central opening 574 extends through circular member 540 and includes a keyway 576 to ensure proper installation of steering arm 194. A raceway 578 extends around circular opening 574 and receives pivot housing raised slot 338 (shown in FIG. 9).

Figure 16:
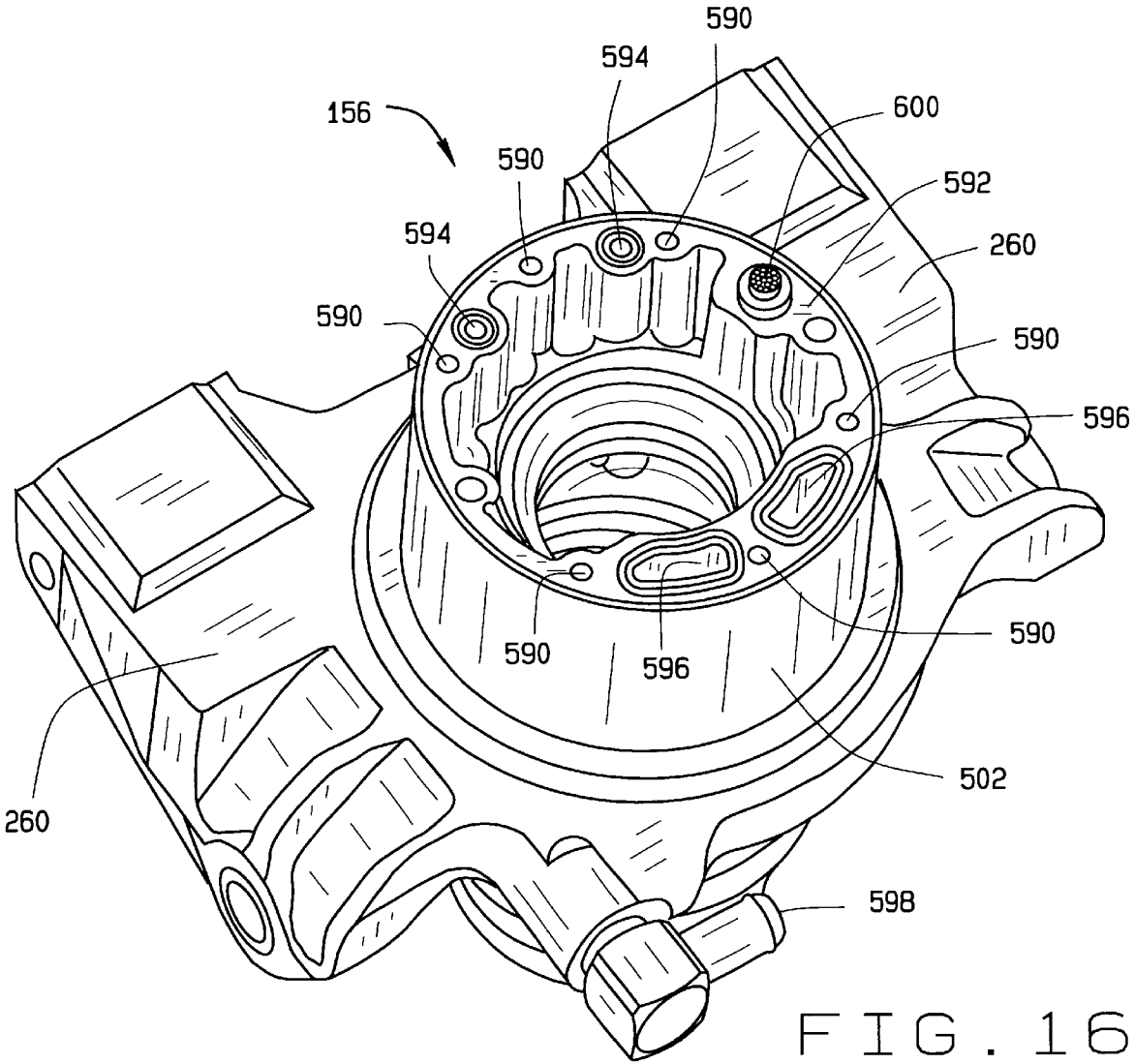
FIG. 16 is a top perspective view of the yoke shown in FIGS. 12–14.

FIG. 16 is a top perspective view of yoke 156 including drum 502 and integral pivot arm 260. Drum 502 is substantially circular and includes a plurality of threaded attachment openings 590 extending partially through a rim 592 of drum 502 for receiving attachment members 570 of steering arm annular portion 568 (shown in FIG. 15). Actuator fluid paths 594 extend through rim 592 to fluid ports (not shown in FIG.

16) located on pivot arm 260 and fluidly communicate with steering arm fluid paths 566 (shown in FIG. 15). Coolant water fluid paths 596 also extend through rim 592 and fluidly communicate with steering arm cooling water inlets 572 (shown in FIG. 15) when steering arm 194 is attached to yoke drum 502. Coolant water fluid paths 596 also are in fluid communication with a cooling water inlet 598 that receives cooling water from trunnion 158 (shown in FIGS. 11–13). Also, a stud 600 projects from rim 592 and is received in steering arm keyway 576 (shown in FIG. 15) to ensure proper installation of steering arm 194 to yoke 156. While the illustrated embodiment depicts yoke 156 with integral drum 502 and pivot arm 260, it is appreciated that in alternative embodiments the drum could be integrally formed with steering arm and the yoke pivot arm attached to the drum without departing from the spirit and scope of the present invention.

Figure 17:
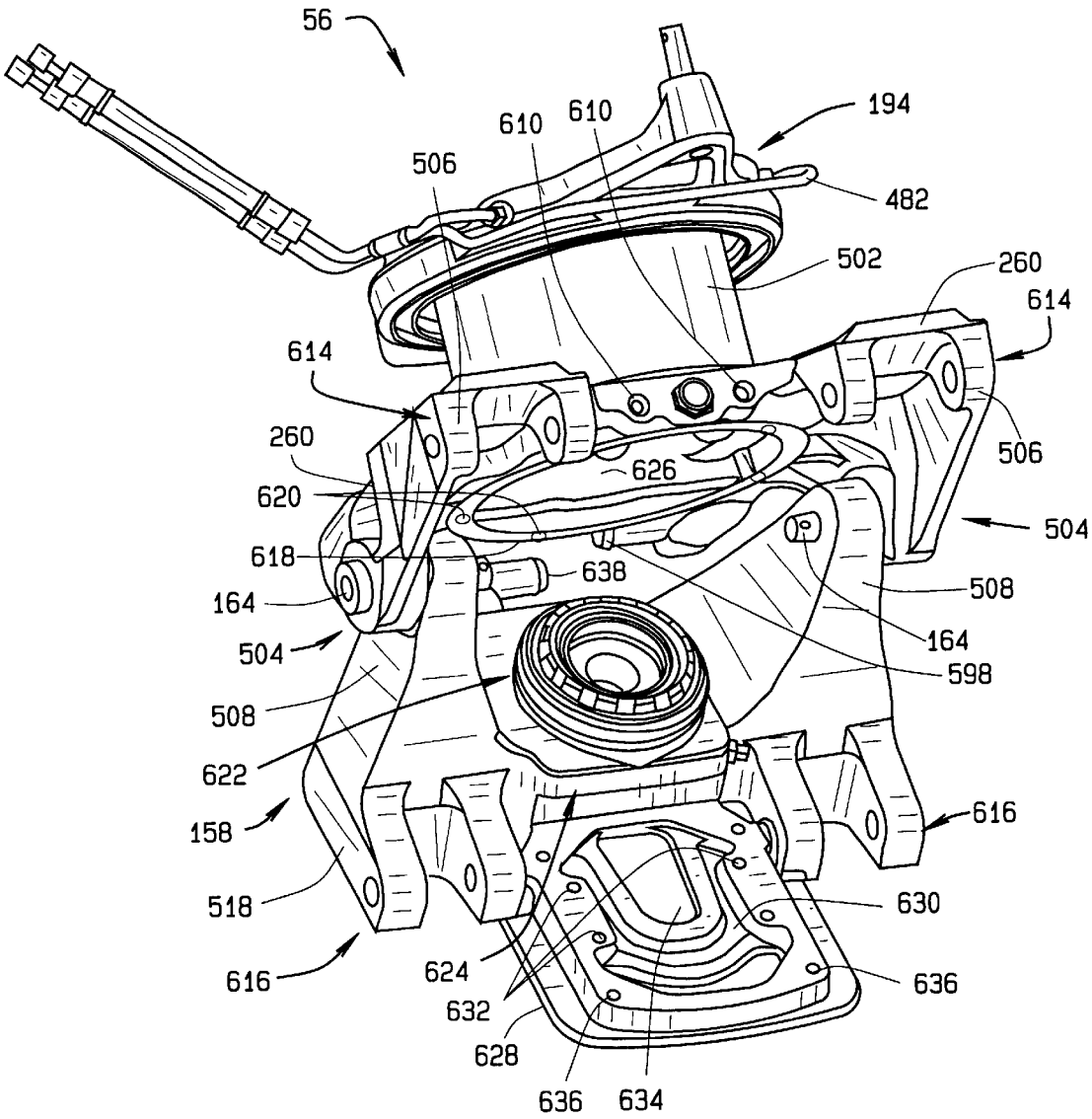
FIG. 17 is a front perspective view of the steering arm yoke and trunnion assembly shown in FIGS. 12–14 with parts removed and in a full tilt up position.

FIG. 17 is a front perspective view of steering arm yoke and trunnion assembly 56 with parts removed and in a full tilt up position. Steering arm 194 is connected to yoke drum 502, and yoke pivot arm 260 is connected to trunnion upper extension 508 via pivot pins 164 through respective pivot connections 504 of yoke pivot arm 260 and trunnion upper extension 508. Actuator fluid ports 610 are positioned on an actuator wall 612 of yoke pivot arm 260. Actuator cylinders 160 (shown in FIG. 12) are connected to respective brackets 614, 616 of yoke pivot arm actuator connection 506 and trunnion lower extension 518, and actuator fluid lines 482 (shown in FIG. 12) are connected to actuator fluid ports 610 to power actuator cylinders 160. A cooling water outlet 638 extends from trunnion 158 to deliver cooling water to yoke cooling water inlet 598 through a fluid member (not shown), such as a hose.

Bellows 520 (shown in FIG. 13) is attached to a lower rim 618 of yoke drum 502 via a plurality of threaded attachment holes 620 therethrough and bellows 520 extends to a bearing retainer 622 in a center portion 624 of trunnion 158 to sleeve the universal joint (not shown) therebetween. Bearing retainer 622 supports bearings (not shown) for rotation of the lower universal joint inside bellows 520, and the lower universal joint is connected to the gearcase drive shaft (not shown). The upper universal joint extends through steering arm central opening 574 (shown in FIG. 15) and a central opening 626 of drum 502 and is coupled to the center universal joint, which, in turn, is coupled to the lower universal joint. The center universal joint is positioned between yoke drum lower rim 618 and bearing retainer 622. Therefore, as rotary motion is imparted to the powerhead output drive shaft (not shown) that is coupled to the upper universal joint, rotary motion is transmitted through the center universal joint to the lower universal joint, and hence to the gearcase drive shaft, regardless of the tilt position of steering arm yoke and trunnion assembly 56.

A plate 628 extends from trunnion center portion 624 and includes a mounting receptacle 630 for a gear shift assembly (not shown in FIG. 17), and a plurality of attachment openings 632 for the gear shift assembly. In an exemplary embodiment, the gear shift assembly includes a reversible electric motor (not shown in FIG. 17) coupled to a shift rod (not shown in FIG. 17) that extends through an opening 634 in plate 628. The shift rod is coupled to gearcase 166 (shown in FIG. 5) for reversing a direction of rotation of propeller 168 (shown in FIG. 5) through the reversible motor in response to operator input. Gear shift cover 486 (shown in FIG. 12) is attached to plate 628 over the gear shift assembly via attachment openings 636 in plate 628.

Figure 18:
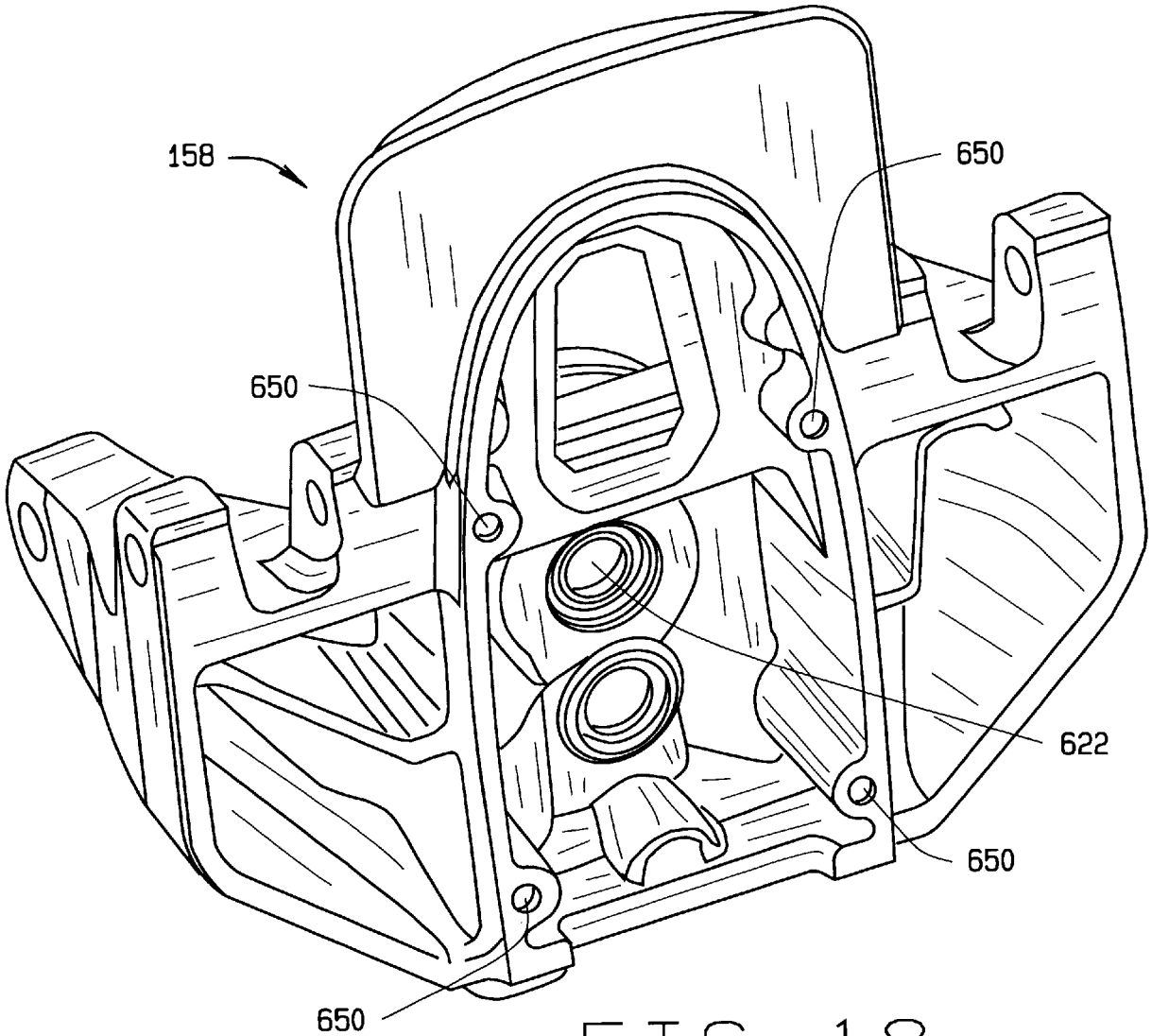
FIG. 18 is a bottom perspective view of the trunnion shown in FIG. 17.
Figure 19:
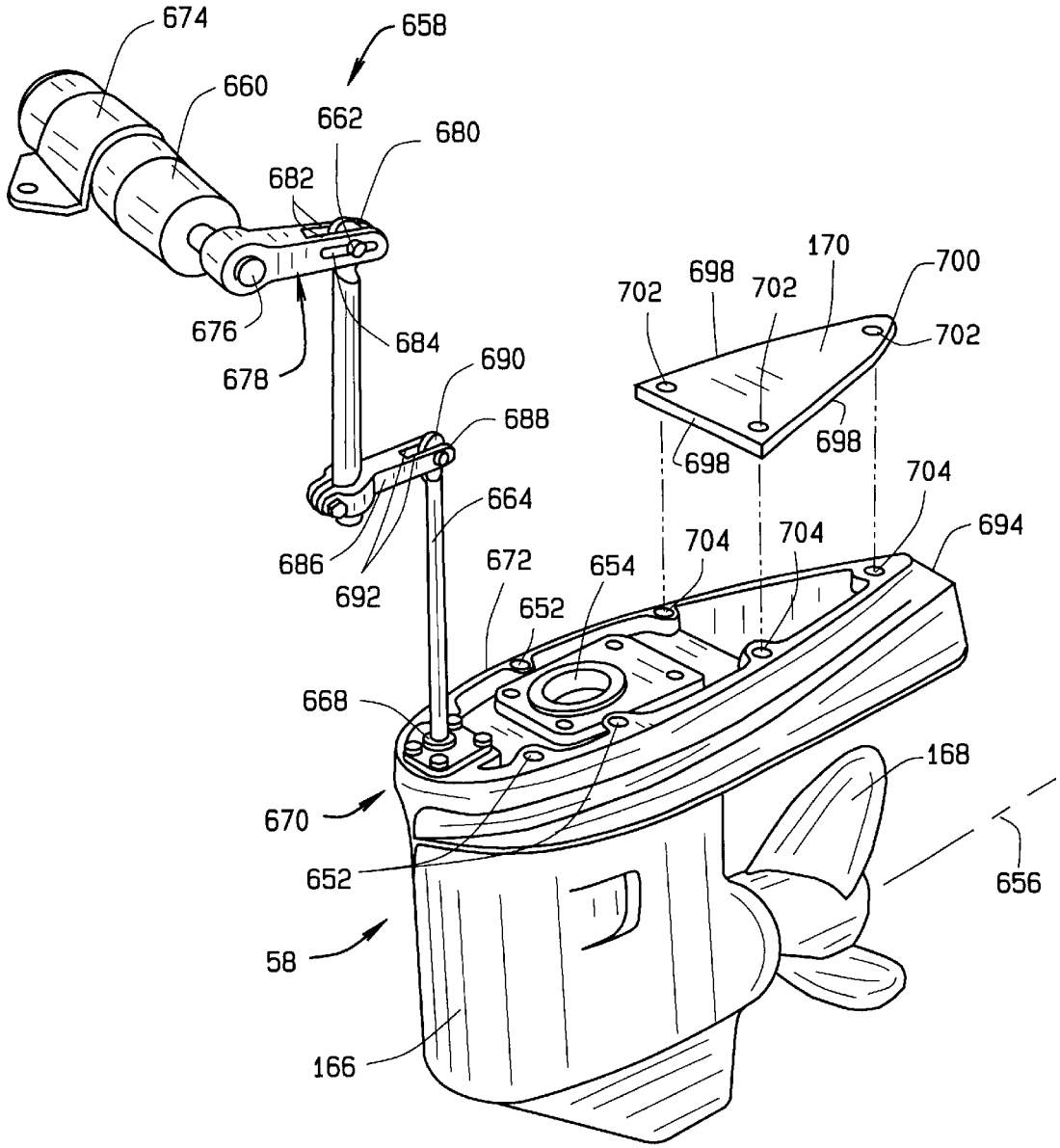
FIG. 19 is a top perspective view of the propeller drive unit and gear shift mechanism for the propulsion system shown in FIG. 5.

FIG. 18 is a bottom perspective view of trunnion 158 including a plurality of attachment openings 650 for connection to attachment openings 652 of propeller drive unit 58 illustrated in FIG. 19. Propeller drive unit 58 includes gearcase 166 and propeller 168. A gearcase drive shaft (not shown) extends through trunnion bearing retainer 622 into a gearcase drive opening 654 and actuates a gearset (not shown) therein to rotate propeller 168 about a thrust axis 656.

An electronic gear shift mechanism 658 determines a direction of rotation of propeller 168, i.e., whether propeller 168 rotates clockwise or counterclockwise about thrust axis 656, and hence determines a direction of propulsion of watercraft 30 (shown in FIGS. 1 and 2). Gear shift mechanism 658 includes a reversible DC electric motor 660, a sliding clevis 662, and shift rod 664 extending through trunnion plate shift rod opening 634 and into a shift rod opening 668 at a rounded end 670 of gearcase top surface 672. Motor 660 is mounted within gear shift cover 486 (shown in FIG. 12) with a mounting bracket 674 and includes a rotating output shaft 676. According to known methods, a direction of rotation of output shaft 676 is reversed by reversing a polarity of motor 660.

An actuator arm 678 is connected to motor output shaft 676 and includes a slotted end 680 having substantially parallel first and second extensions 682 including oblong openings 684. Clevis 662 extends through oblong openings 684 for sliding movement within oblong openings 684 and is attached to extensions 682 using known attachment members (not shown), including but not limited to a pin (not shown). Clevis 662 extends away from actuator arm 678 and is bolted to an attachment bracket 686 that, in turn, includes a slotted end 688 for receiving an attachment end 690 of shift rod 664 between attachment bracket extensions 692. Attachment bracket extensions 692 are pivotally mounted to shift rod attachment end 690 so that as motor output shaft 676 rotates, sliding clevis 662 moves attachment bracket 686 accordingly until attachment bracket 686 exerts a sufficient actuating force on shift rod attachment end 690 to cause shift rod 664 to actuate a transmission (not shown) within gearcase 166 between a neutral position, a forward, position, and a reverse position.

In one embodiment, gear reduction is employed within the gearset according to known techniques, and the polarity of motor 660, rotation of motor shaft 676, and position of shift rod 664 is determined by known electronic, logic driven controls (not shown). In a further embodiment, gear reduction allows a fractional horsepower DC electric motor to be used, which reduces required space for motor 660 within gear shift cover 486 (shown in FIG. 12).

When enclosed with gear shift cover 486, gear shift mechanism 658 ably actuates forward, reverse, and neutral conditions of propeller 168 in a waterproof environment that rotates and turns with propeller drive unit 58 in all drive unit positions. Also, gear shift mechanism 658 is relatively compact and relatively simple in comparison to known shifting mechanisms, such as intricate shift lever, hydraulic, and cable systems that are difficult to water seal. In addition, gear shift mechanism 658 reduces helm friction experienced by an operator in comparison to known shifting mechanisms.

In one embodiment, a removable gearcase plate 170 is attached to a tapered end 694 of gearcase top surface 672 to close gearcase top surface 672 after gearcase rounded end 670 is attached to trunnion 158. Gearcase plate 170 includes contoured edges 698 that generally conform to gearcase top surface tapered end 694, and a flat leading edge 698 opposite a tapered end 700 that is distanced from gearcase drive opening 654 when gearcase plate 170 is attached to gearcase top surface tapered end 694. In other words, removable gearcase plate 170 covers only a portion of gearcase top surface 672 aft trunnion connection openings 652. Removable gearcase plate 170 is attached to gearcase 166 with known attachment members (not shown) extending through attachment openings 702 in removable gearcase plate and into aligned attachment openings 704 on gearcase top surface 672. Known sealing mechanisms (not shown) are used to form a watertight seal between gearcase plate 170 and gearcase top surface 672.

Removable gearcase plate 170 eases marine propulsion 34 system installation, or uninstallation, by allowing gearcase 166 to be attached to trunnion 158 after steering arm yoke and trunnion assembly 56 is assembled and mounted to horizontal mounting plate 48 (as shown in FIG. 5). Thus, a pre-assembled upper unit 42, horizontal mounting plate 48 and steering arm yoke and trunnion assembly 56 may be dropped down through platform engine compartment recess 114 from above until horizontal mounting plate 48 is received in platform recess 114. (See FIGS. 1–4.) Horizontal mounting plate 48 is secured to platform 35 via shelf attachment holes 112 in engine compartment horizontal surface 82 (shown in FIGS. 2 and 3), and propeller drive unit 58 is attached to steering arm yoke and trunnion assembly 56 by attaching gearcase 166 to trunnion 158 and attaching removable gearcase plate 170 to gearcase 166. Installation of marine propulsion system 34 is completed by making hydraulic, fuel, electrical, and control system connections. Therefore, pre-assembly of marine propulsion system 34 components simplifies installation and reduces installation costs. Coupled with the cost savings of outboard powerhead 150, marine propulsion system 34 reduces the cost of a completed watercraft 30.

In an alternative embodiment, gearcase plate 170 is fixed to drive unit 58, and marine propulsion system upper and lower units, 42, 54 (shown and described above) are fully pre-assembled, mounted to mounting assembly 52 (shown and described above) and tested. The mounted assembly is lowered through platform engine compartment recess 114 (shown in FIGS. 3 and 4) so that lower unit 54 extends below platform engine compartment shelf 110 (shown in FIGS. 3 and 4) and upper unit 42 extends above platform engine compartment shelf 110. Mounting assembly 52 is then secured horizontally to platform engine compartment shelf 110. Marine propulsion system installation is completed by making hydraulic connections for trim, tilt, and steering of propeller drive unit 58, and by making appropriate fuel, electrical and control system connections to the various components of propulsion system 34. Marine propulsion system 34 may therefore be quickly and simply installed with a drop down assembly and four point attachment process to watercraft 30 (shown in FIGS. 1 and 2), further reducing manufacturing and assembly costs of a completed watercraft 30.

Aside from assembly considerations, mounting of outboard powerhead 150 in platform engine compartment 40 provides the performance advantages and aesthetic qualities of conventional inboard systems with the cost effectiveness of conventional outboard systems, and further provides a more evenly distributed structural load to horizontal mounting plate 48 as compared to conventional, vertically mounted outboard systems. Moreover, the compactness of outboard powerhead 150 increases a usable space of watercraft 30 relative to conventional inboard systems, and insulated engine cover 43 (shown in FIGS. 1 and 2) reduces engine noise to watercraft occupants. In addition, the reduced weight of outboard powerhead 150 and a reduced weight of marine propulsion system lower unit 54 relative to conventional inboard systems increases fuel economy and performance of watercraft 30.

Mounting assembly 52 (shown in FIGS. 5 and 10) reduces vibration of marine propulsion system upper and lower units 42, 54 that negatively affects the boating experience. Mounting assembly also facilitates maintenance and serviceability of marine propulsion system 34 by the ease of installing and removing powerhead 150 as necessary for unobstructed access to desired areas and parts of the system.

Figure 20:
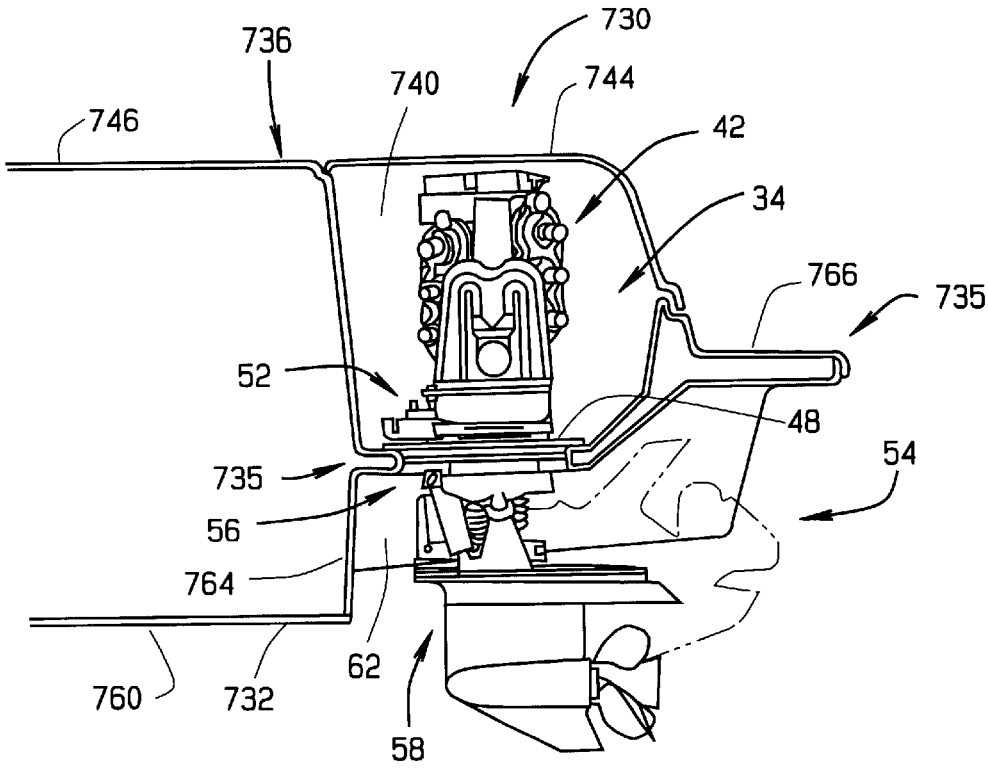
FIG. 20 is a partial cross sectional view of a second embodiment of a watercraft including the marine propulsion system shown in FIGS. 4–6.

FIG. 20 is a partial cross sectional view of a second embodiment of a watercraft, or boat, 730 including a hull 732 and marine propulsion system 34 attached to a platform 735 extending from hull 732 to generate thrust to propel watercraft 730 through a body of water. Platform 735 is integrally formed with hull 732 and includes an upper unit 42 of marine propulsion system 34 in an outside engine compartment 740 located aft a rear end 736 of a boat interior (not shown in FIG. 20). Engine compartment 740 is closed with an insulated engine cover 744 adjacent and generally flush with a watercraft deck 746 to improve aesthetics of watercraft 730 and to reduce engine noise to watercraft occupants. Horizontal mounting plate 48 is received in a platform recess (not shown in FIG. 20) extending through engine compartment 740 and is secured to platform 735. Mounting assembly 52 secures upper unit 42 to horizontal mounting plate 48. Lower unit 54 of marine propulsion system 34 is also attached to horizontal mounting plate 48 and includes steering arm yoke and trunnion assembly 56 coupled to a propeller drive unit 58 depending therefrom for rotational movement of lower unit 54 relative to stationary upper unit 42 to steer watercraft 730, and allows adjustment of a trim and tilt position of lower unit 54 between a full tilt down position (shown in solid in FIG. 20) and a full tilt up position (shown in phantom in FIG. 20).

Hull 732 includes a running surface 760 generally which, when watercraft is planing, rides on the surface of the water, and a pair of platform extensions 762 (only one of which is shown in FIG. 20) flank steering arm yoke and trunnion assembly 56 and support platform 36. Extensions 762 extend from a vertical wall 764 substantially perpendicular to running surface 760 and toward engine compartment 740. A ledge 766 extends rearward from engine compartment 740 that users may stand on and to enter and exit boat 730. Ledge 766 also prevents water from splashing into engine compartment 740 when watercraft 730 is propelled by marine propulsion system 34 in a reverse direction and when a speed of watercraft 730 in a forward direction is suddenly decreased.

Figure 21:
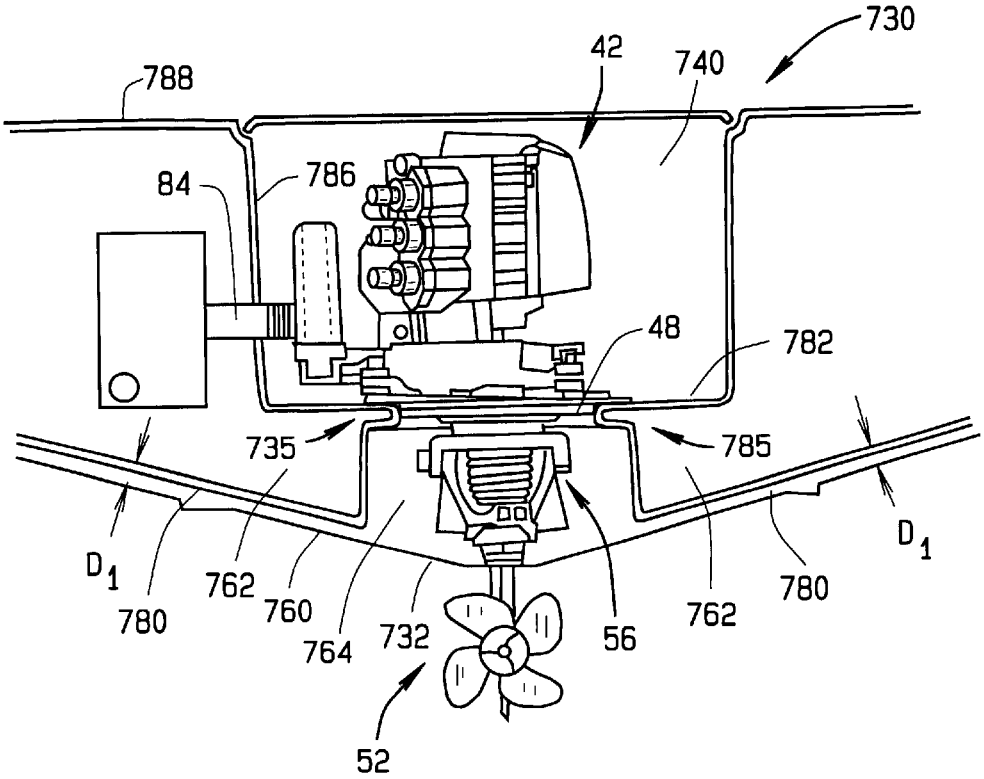
FIG. 21 is another partial cross sectional view of the watercraft shown in FIG. 20.

FIG. 21 is a partial transverse cross sectional view of watercraft 730 through engine compartment 740. Extensions 762 flank steering arm yoke and trunnion assembly 56 and each include an extension bottom surface 780 at a distance $D_1$ above hull running surface 760. Horizontal mounting plate 48 rests in a recess (not shown in FIG. 21) through a horizontal surface 782 of platform engine compartment 740 and, (shown in FIGS. 1–4), is secured to platform 735 to join marine propulsion upper and lower units 42, 54. Exhaust pipe 84 extends through a side wall 786 of engine compartment 740 and exhausts combustion gases to the atmosphere below a top surface 788 of platform 735. Hull 732 is generally V-shaped and fabricated from known materials, and deck 746 (shown in FIG. 20) is attached to hull 732 using known techniques.

Figure 22:
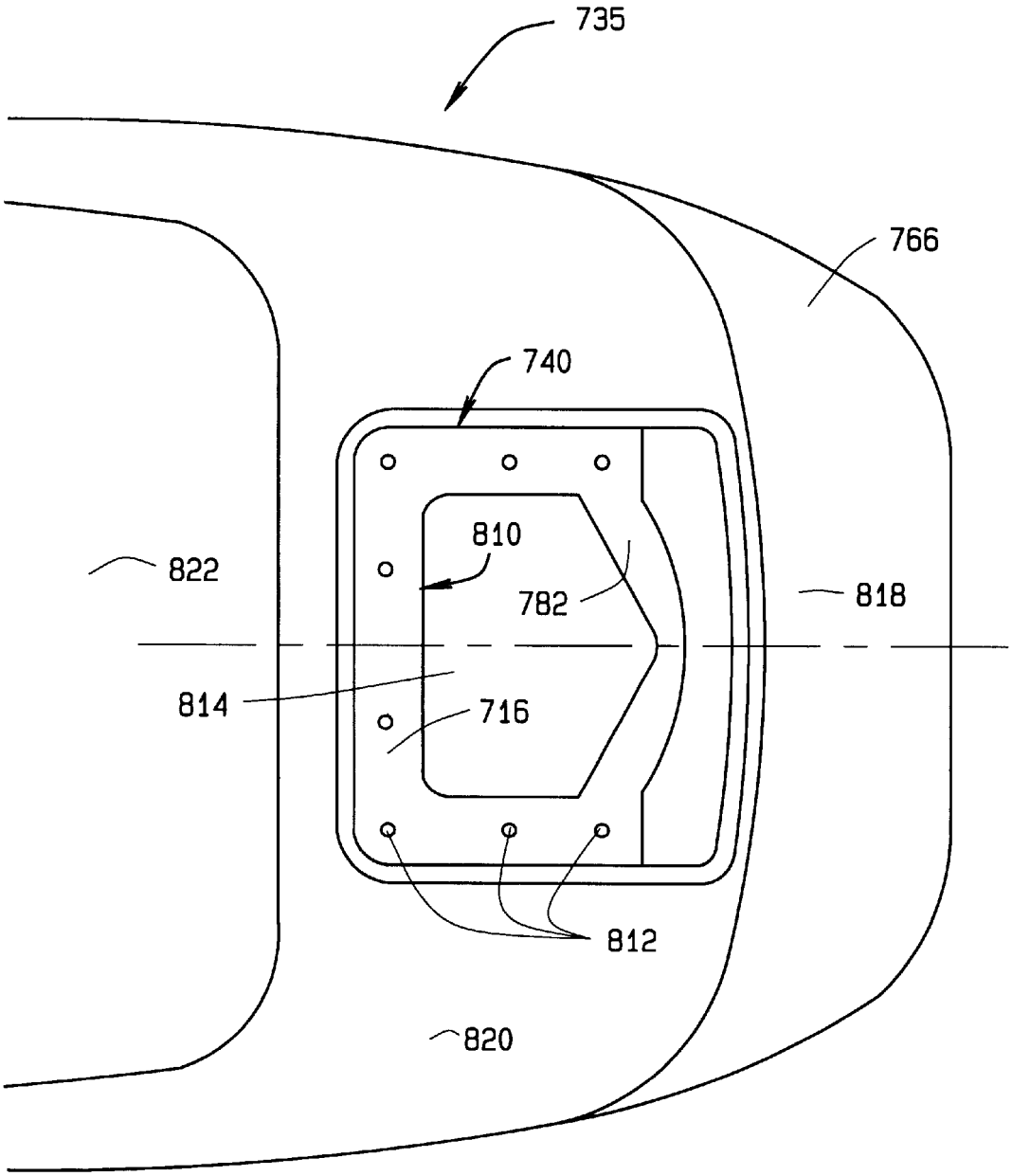
FIG. 22 is a partial top plan view of the watercraft shown in FIG. 20 with parts removed.

FIG. 22 is a partial top plan view of watercraft 730 illustrating engine compartment 740 with engine cover 744

(shown in FIGS. 20 and 21) and marine propulsion system 34 (shown in FIGS. 20 and 21) removed. A shelf 810 is formed into platform 735 at an engine compartment horizontal surface 782 and includes a plurality of attachment holes 812 for securing horizontal mounting plate 48 (shown in FIGS. 20 and 21) to platform 735. A recess 814 extends through engine compartment horizontal surface 782 and is shaped to ease installation of marine propulsion system 34. Recess 814 extends through platform 735 between extensions 762 to extension bottom surfaces 780 (shown in FIG. 21). Thus, upper unit 42 (shown in FIG. 20) extends upward from horizontal mounting plate 48 through recess 814, and lower unit 54 (shown in FIG. 20) extends downward from horizontal mounting plate 48 through recess 814 and into a body of water when watercraft 730 is used. Upper unit 42 is mounted stationary to recess 814, and hence to platform shelf 810, while lower unit 54 is free to rotate, trim, and tilt for steering and maneuvering lower unit 54 relative to platform shelf 810.

Ledge 766 extends rearward of engine compartment 740 and forms a surface 818 which, in one embodiment, is padded for use as a sundeck. Engine compartment 740 is separated from a watercraft interior 822, and interior 822 includes seats and storage space (not shown in FIG. 22). In alternative embodiments, seats or storage spaces are located adjacent outside engine compartment side walls 786.

The operation of watercraft 730 and marine propulsion system are substantially the same as described above in relation to watercraft 30, and the corresponding benefits and advantages of watercraft 30 are also realized in watercraft 730.

While the invention has been described in terms of various specific embodiments, those skilled in the art will recognize that the invention can be practiced with modification within the spirit and scope of the claims.

What is claimed is:

1. A gear shift mechanism for a marine propulsion system including a gearcase and a propeller, said gear shift mechanism including:

a reversible motor comprising a motor shaft;

a clevis coupled to said motor shaft for movement therewith; and a shift rod coupled to said clevis and configured for manipulation of the gearcase to change a direction of rotation of the propeller.

2. A gear shift mechanism in accordance with claim 1 wherein said motor is a DC electric motor.

3. A gear shift mechanism in accordance with claim 2 wherein said motor is a fractional horsepower motor.

4. A gear shift mechanism in accordance with claim 1 further comprising an actuator arm connected to said motor shaft; said actuator arm comprising at least one opening, said opening receiving said clevis.

5. A gear shift mechanism in accordance with claim 4 wherein said opening is oblong, thereby allowing sliding movement of said clevis within said opening.

6. A gear shift mechanism in accordance with claim 4 further comprising an attachment bracket connected to said clevis and to said shift rod.

7. A gear shift mechanism in accordance with claim 6 wherein said attachment bracket includes a slotted end, said shift rod comprises an attachment end; said shift rod attachment end received in said slotted end.

8. A gear shift assembly in accordance with claim 7 wherein said attachment bracket slotted end is pivotally mounted to said shift rod attachment end.

9. A gear shift mechanism in accordance with claim 1 further comprising a gear shift cover enclosing said gear shift mechanism.

10. A gear shift mechanism in accordance with claim 9, said motor mounted within said gear shift cover.

11. A gear shift assembly for a marine propulsion system, said gear shift assembly comprising:

a propeller;

a gearcase coupled to said propeller for rotation thereof, said gearcase comprising a top surface comprising a shift rod opening;

a gear shift mechanism coupled to said gearcase and comprising a shift rod extending through said shift rod opening to change a direction of rotation of said propeller, a motor comprising a motor shaft, and a clevis coupled to said motor shaft and coupled to said shift rod; and a gear shift cover enclosing said gear shift mechanism and coupled to said gearcase.

12. A gear shift assembly in accordance with claim 11 wherein said shift rod extends into said shift rod opening.

13. A gear shift assembly in accordance with claim 11 wherein said motor is a DC electric motor.

14. A gear shift assembly in accordance with claim 13 wherein said motor is a fractional horsepower motor.

15. A gear shift assembly in accordance with claim 11 further comprising an actuator arm connected to said motor shaft, said actuator arm comprising at least one opening, said opening receiving said clevis.

16. A gear shift assembly in accordance with claim 15 wherein said opening is oblong, thereby allowing sliding movement of said clevis within said opening.

17. A gear shift assembly in accordance with claim 15 further comprising an attachment bracket connected to said clevis and to said shift rod.

18. A gear shift assembly in accordance with claim 17 wherein said attachment bracket includes a slotted end, said shift rod comprises an attachment end, said shift rod attachment end received in said slotted end.

19. A gear shift assembly in accordance with claim 18 wherein said attachment bracket slotted end is pivotally mounted to said shift rod attachment end.

20. A gear shift assembly in accordance with claim 11 said motor mounted to said gear shift cover.

21. A gear shift assembly in accordance with claim 11 wherein said gearcase top surface comprises a rounded end and a tapered end, said cover attached to said rounded end.

22. A gear shift assembly in accordance with claim 21 further comprising a trunnion, said trunnion attached to said gearcase top surface rounded end, said cover attached to said trunnion.

23. A gear shift assembly in accordance with claim 22 further comprising a removable gearcase plate attached to said tapered end of said gearcase top surface.

24. A marine propulsion system for a watercraft including a platform having a recess therethrough, said marine propulsion system comprising:

a powerhead;

a mounting assembly configured for horizontally mounting said powerhead to the platform;

a steering arm yoke and trunnion assembly pivotally mounted with respect to said mounting assembly and configured for rotation about a vertical axis;

a propeller drive unit comprising a gearcase and a propeller attached to said steering arm yoke and trunnion assembly and operatively coupled to said powerhead for rotation of said propeller; and a gear shift mechanism coupled to said gearcase for selecting a forward, reverse, or neutral rotation of said propeller, said gear shift mechanism comprising:

a motor, a clevis coupled to said motor, and a shift rod coupled to said clevis, said shift rod coupled to said gearcase and configured for selectively shifting said shift rod between said forward, reverse, and neutral positions.

25. A marine propulsion system in accordance with claim 24 wherein said motor is a DC electric motor.

26. A marine propulsion system in accordance with claim 25 wherein said motor is a fractional horsepower motor.

27. A marine propulsion system in accordance with claim 26 further comprising an attachment bracket connected to said clevis and to said shift rod.

28. A marine propulsion system in accordance with claim 27 wherein said attachment bracket includes a slotted end, said shift rod comprises an attachment end; said shift rod attachment end received in said slotted end.

29. A marine propulsion system in accordance with claim 28 wherein said attachment bracket slotted end is pivotally mounted to said shift rod attachment end.

30. A marine propulsion system in accordance with claim 24 further comprising an actuator arm connected to the shaft of said motor, said actuator arm comprising at least one opening, said opening receiving said clevis.

31. A marine propulsion system in accordance with claim 30 wherein said opening is oblong, thereby allowing sliding movement of said clevis within said opening.

32. A marine propulsion system in accordance with claim 24 further comprising a gear shift cover enclosing said gear shift mechanism.

33. A marine propulsion system in accordance with claim 32, said motor mounted within said gear shift cover.

34. A marine propulsion system in accordance with claim 32 wherein said steering arm yoke and trunnion assembly comprises a trunnion, said gear shift cover attached to said trunnion.

35. A marine propulsion system in accordance with claim 24 wherein said gearcase comprises a top surface comprising a rounded end and a tapered end, said gear shift mechanism attached to said rounded end.

36. A marine propulsion system in accordance with claim 35 further comprising a removable gearcase plate attached to said tapered end.

37. A marine propulsion system comprising:

a horizontal mounting plate;

an upper unit mounted stationary to said horizontal mounting plate;

a lower unit rotatably mounted to said horizontal mounting plate and configured for pivotal movement relative to said upper unit, said lower unit comprising a gearcase and a propeller; and means for shifting said gearcase and changing a direction of rotation of said propeller, said means for shifting said gear case mounted stationary to said lower unit.

38. A marine propulsion system in accordance with claim 37 wherein said upper unit comprises an outboard powerhead.

39. A marine propulsion system in accordance with claim 38 wherein said means for shifting said gearcase comprises a motor, a clevis coupled to said motor, and a shift rod coupled to said clevis and configured for selectively shifting said shift rod between a forward, reverse and neutral position.

40. A marine propulsion system in accordance with claim 39 wherein said motor comprises a reversible electric motor.

41. A marine propulsion system in accordance with claim 38 further comprising a gearshift cover attached to said lower unit, said means for shifting said gearcase contained in said gear shift cover.

42. A marine propulsion system in accordance with claim 41 wherein said gear shift cover is mounted stationary to said lower unit.

* * * * *